US009546659B2

(12) United States Patent
Ogata et al.

(10) Patent No.: US 9,546,659 B2
(45) Date of Patent: Jan. 17, 2017

(54) ROTARY COMPRESSOR

(75) Inventors: Takeshi Ogata, Osaka (JP); Yu Shiotani, Osaka (JP); Akira Hiwata, Shiga (JP); Hiroshi Hasegawa, Osaka (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 401 days.

(21) Appl. No.: 14/004,041

(22) PCT Filed: Feb. 23, 2012

(86) PCT No.: PCT/JP2012/001235
§ 371 (c)(1),
(2), (4) Date: Sep. 9, 2013

(87) PCT Pub. No.: WO2012/120808
PCT Pub. Date: Sep. 13, 2012

(65) Prior Publication Data

US 2013/0343942 A1 Dec. 26, 2013

(30) Foreign Application Priority Data

Mar. 10, 2011 (JP) ..... 2011-052364

(51) Int. Cl.
*F04C 28/26* (2006.01)
*F04C 28/08* (2006.01)
(Continued)

(52) U.S. Cl.
CPC ..... *F04C 28/26* (2013.01); *F04C 28/08* (2013.01); *F04C 18/3564* (2013.01);
(Continued)

(58) Field of Classification Search
CPC ..... F04C 28/16; F04C 28/18; F04C 28/24; F04C 28/26; F04C 28/065; F04C 2240/403
See application file for complete search history.

(56) References Cited

U.S. PATENT DOCUMENTS 4,408,968 A * 10/1983 Inagaki ..... F04C 28/16 418/15
4,989,414 A 2/1991 Murayama et al.
6,619,062 B1 * 9/2003 Shibamoto ..... F04C 18/0253 62/196.1
2004/0071560 A1 * 4/2004 Cho ..... F04C 23/001 417/223
2004/0184922 A1 9/2004 Cho et al.
2006/0002809 A1 1/2006 Kawabe et al.
(Continued)

FOREIGN PATENT DOCUMENTS

CN 1532421 9/2004
CN 1761817 4/2006
(Continued)

*Primary Examiner* — Devon Kramer
*Assistant Examiner* — Kenneth J Hansen
(74) *Attorney, Agent, or Firm* — Hamre, Schumann, Mueller & Larson, P.C.

(57) ABSTRACT

A rotary compressor (100) includes a compression mechanism (3), a motor (2), a suction path (14), a back-pressure chamber (18), a return path (16), an inverter (42), and a controller (44). A check valve (73) of a reed valve type for opening and closing a return port (3*c*) of the compression mechanism (3) is disposed in the back-pressure chamber (18). The return path (16) functions to return a working fluid to the suction path (14) from the back-pressure chamber (18). A volume-varying valve (17) is provided in the return path (16). The volume-varying valve (17) allows the working fluid to flow through the return path (16) when the suction volume of the compression mechanism (3) should be set relatively small, and precludes the working fluid from flowing through the return path (16) to increase the pressure in the back-pressure chamber (18) when the suction volume of the compression mechanism (3) should be set relatively large.

12 Claims, 16 Drawing Sheets

(51) Int. Cl.
*F04C 18/356* (2006.01)
*F04C 23/00* (2006.01)

(52) U.S. Cl.
CPC ..... *F04C 23/001* (2013.01); *F04C 23/008* (2013.01); *F04C 2240/403* (2013.01)

(56) References Cited

U.S. PATENT DOCUMENTS

| | | | | |
|---|---|---|---|---|
| 2006/0090488 | A1* | 5/2006 | Hwang | F04C 23/001 62/175 |
| 2006/0093494 | A1* | 5/2006 | Kitaichi | F01C 21/007 417/415 |
| 2006/0177336 | A1* | 8/2006 | Hwang | F04C 18/04 418/59 |
| 2011/0142705 | A1* | 6/2011 | Park | F04C 18/3564 418/107 |

FOREIGN PATENT DOCUMENTS

| | | |
|---|---|---|
| CN | 101684800 | 3/2010 |
| JP | 61-184365 | 8/1986 |
| JP | 62-255212 | 11/1987 |
| JP | 63-021792 U | 2/1988 |
| JP | 2-118362 | 5/1990 |
| JP | 2-191882 | 7/1990 |
| JP | 2006-022761 | 1/2006 |
| JP | 2006-161701 | 6/2006 |
| WO | 2006/014081 | 2/2006 |

* cited by examiner

ROTARY COMPRESSOR

TECHNICAL FIELD

The present invention relates to rotary compressors.

BACKGROUND ART

A motor of a compressor is usually controlled by an inverter and a microcomputer. If the rotational speed of the motor is decreased, a refrigeration cycle apparatus in which the compressor is used can be operated with a power sufficiently lower than a rated value. In addition, Patent Literature 1 provides a technique for operating a refrigeration cycle apparatus with such a low power as cannot be realized by inverter control.

FIG. 16 is a configuration diagram of an air conditioner described in Patent Literature 1. A refrigeration cycle is constituted by a compressor 715, a four-way valve 717, an indoor heat exchanger 718, a pressure reducing device 719, and an outdoor heat exchanger 720. A cylinder of the compressor 715 is provided with an intermediate discharge port that opens from the start of a compression process to some point in the process. The intermediate discharge port is connected to a suction path of the compressor 715 via a bypass path 723. The bypass path 723 is provided with a flow rate control device 721 and a solenoid on-off valve 722. The solenoid on-off valve 722 is opened only in operation performed at a low set frequency. This allows operation to be performed with a lower power.

CITATION LIST

Patent Literature

Patent Literature 1: JP 561(1986)-184365 A

SUMMARY OF INVENTION

Technical Problem

Here, a straightforward way to improve the efficiency of a refrigeration cycle apparatus is to improve the efficiency of a compressor. The efficiency of the compressor largely depends on the efficiency of a motor used in the compressor. Many motors are designed to exhibit the highest efficiency at a rotational speed close to a rated rotational speed (e.g., 60 Hz). Therefore, when the motor is driven at an extremely low rotational speed, increase in the efficiency of the compressor cannot be expected. Furthermore, in the case where a power-varying mechanism such as a bypass path is provided, there is a major problem in that the efficiency of the compressor is reduced not only when the mechanism is in operation but also when the mechanism is not in operation.

In view of such circumstances, the present invention aims to provide a rotary compressor that can exhibit high efficiency when a low power is required (when the load is small) and that can exhibit high efficiency also when normal operation is performed (when the load is large).

Solution to Problem

That is, the present invention provides a rotary compressor including:

a compression mechanism including
- a cylinder,
- a piston disposed inside the cylinder so as to form a working chamber between an outer circumferential surface of the piston and an inner circumferential surface of the cylinder,
- a vane that divides the working chamber into a suction chamber and a compression-discharge chamber,
- a suction port through which a working fluid to be compressed flows into the suction chamber,
- a discharge port through which the working fluid having been compressed flows out of the compression-discharge chamber, and
- a return port through which the working fluid is allowed to escape from the compression-discharge chamber;

a shaft having an eccentric portion fitted to the piston;

a motor that rotates the shaft;

a suction path through which the working fluid is directed to the suction port;

a back-pressure chamber that communicates with the return port;

a check valve of a reed valve type that is provided in the back-pressure chamber and that elastically deforms to open and close the return port;

a return path through which the working fluid is returned from the back-pressure chamber to the suction path;

a volume-varying valve that is provided in the return path, that allows the working fluid to flow through the return path when a suction volume of the compression mechanism should be set relatively small, and that precludes the working fluid from flowing through the return path to increase a pressure inside the back-pressure chamber when the suction volume should be set relatively large;

an inverter that drives the motor; and a controller that controls the volume-varying valve and the inverter so as to compensate for a decrease in the suction volume with an increase in a rotational speed of the motor.

Advantageous Effects of Invention

According to the above configuration, when the volume-varying valve allows the working fluid to flow through the return path, the rotary compressor can be operated with a relatively small suction volume since the working fluid returns to the suction path from the compression-discharge chamber through the return port, the back-pressure chamber, and the return path. On the other hand, when the volume-varying valve precludes the working fluid from flowing through the return path, the rotary compressor can be operated with a relatively large suction volume, that is, a normal suction volume. Furthermore, according to the present invention, the volume-varying valve and the inverter are controlled so as to compensate for a decrease in the suction volume with an increase in the rotational speed of the motor. That is, the motor is not driven at a low rotational speed, but the suction volume is decreased instead. Accordingly, a rotary compressor that can exhibit high efficiency even when the load is small can be provided. In addition, the use of the check valve of a reed valve type makes it possible to open and close the return port with a simple configuration.

DESCRIPTION OF EMBODIMENTS

First Embodiment

Figure 1:
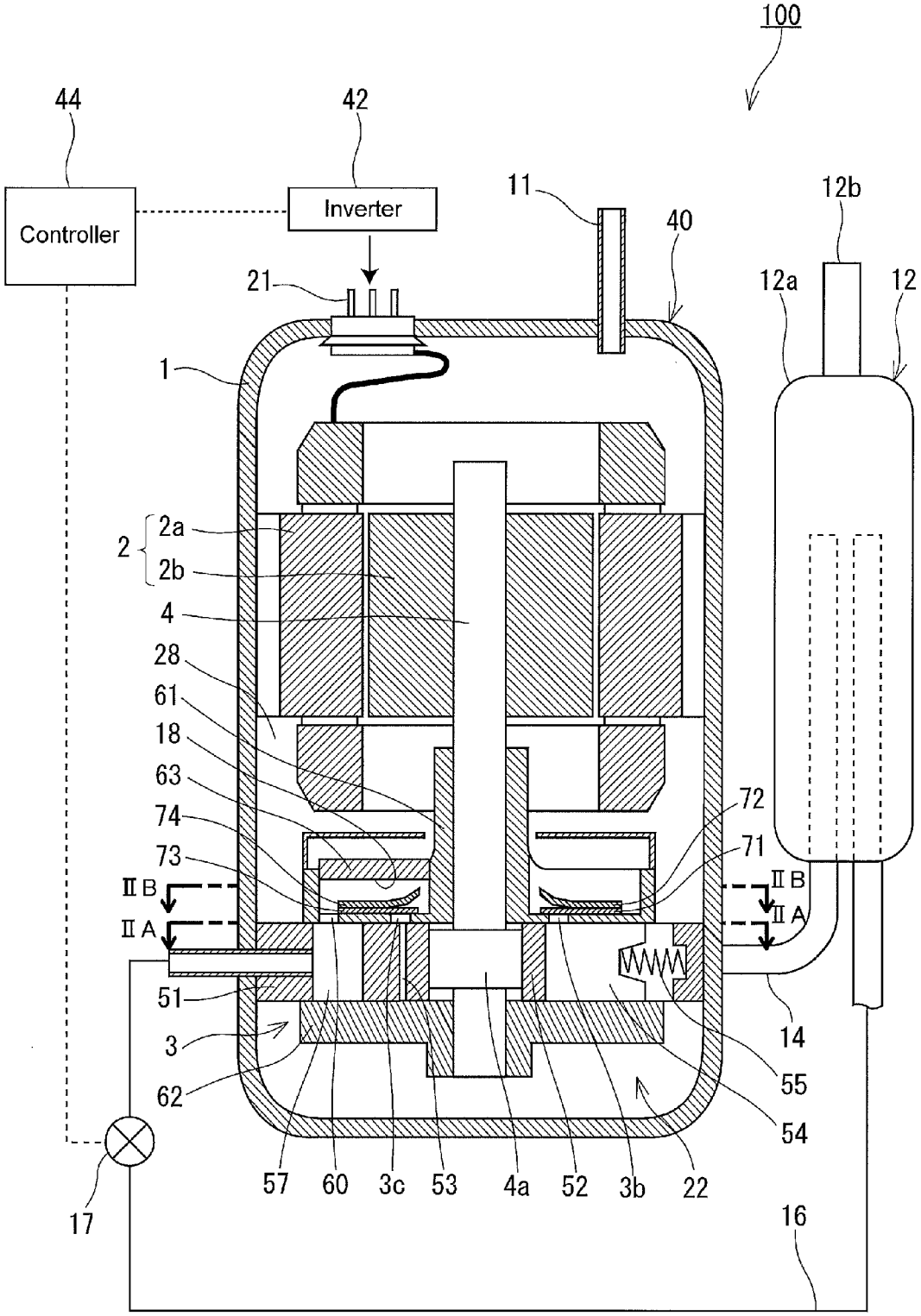
FIG. 1 is a longitudinal cross-sectional view of a rotary compressor according to a first embodiment of the present invention.

As shown in FIG. 1, a rotary compressor 100 of the present embodiment includes a compressor body 40, an accumulator 12, a suction path 14, a discharge path 11, a return path 16, an inverter 42, and a controller 44.

The compressor body 40 includes a closed casing 1, a motor 2, a compression mechanism 3, and a shaft 4. The compression mechanism 3 is disposed in a lower portion of the closed casing 1. The motor 2 is disposed above the compression mechanism 3 in the closed casing 1. The shaft 4 extends in a vertical direction, and connects the compression mechanism 3 to the motor 2. A terminal 21 for supplying electric power to the motor 2 is provided at the top of the closed casing 1. An oil reservoir 22 for retaining a lubricating oil is formed in a bottom portion of the closed casing 1. The compressor body 40 has a structure of a so-called hermetic compressor.

The motor 2 is composed of a stator 2*a* and a rotor 2*b*. The stator 2*a* is fixed to the inner circumferential surface of the closed casing 1. The rotor 2*b* is fixed to the shaft 4, and rotates together with the shaft 4. A motor whose rotational speed is variable, such as an IPMSM (Interior Permanent Magnet Synchronous Motor) and a SPMSM (Surface Permanent Magnet Synchronous Motor), can be used as the motor 2. The motor 2 is driven by the inverter 42.

The controller 44 controls the inverter 42 to adjust the rotational speed of the motor 2, that is, the rotational speed of the rotary compressor 100. A DSP (Digital Signal Processor) including an A/D conversion circuit, an input/output circuit, an arithmetic circuit, a storage device, etc., can be used as the controller 44.

The discharge path 11, the suction path 14, and the return path 16 are each formed by a pipe. The discharge path 11 penetrates through the top of the closed casing 1, and opens into an internal space 28 of the closed casing 1. The discharge path 11 functions to direct a working fluid (typically, a refrigerant) having been compressed to the outside of the compressor body 40. The suction path 14 extends from the accumulator 12 to the compression mechanism 3, and penetrates through a trunk portion of the closed casing 1. The suction path 14 functions to direct the refrigerant to be compressed from the accumulator 12 to a suction port 3*a* of the compression mechanism 3. The return path 16 extends from the compression mechanism 3 to the accumulator 12, and penetrates through the trunk portion of the closed casing 1. The return path 16 functions to return the refrigerant that has been discharged from a working chamber 53 of the compression mechanism 3 without being compressed, to the suction path 14 from a back-pressure chamber 18 described later.

The accumulator 12 is composed of an accumulation container 12*a* and an introduction pipe 12*b*. The accumulation container 12*a* has an internal space capable of retaining the liquid refrigerant and the gaseous refrigerant. The introduction pipe 12*b* penetrates through the top of the accumulation container 12*a*, and opens into the internal space of the accumulation container 12*a*. The suction path 14 and the return path 16 are each connected to the accumulator 12 in such a manner as to penetrate through the bottom of the accumulation container 12*a*. The suction path 14 and the return path 16 extend upward from the bottom of the accumulation container 12*a*, and the upstream end of the suction path 14 and the downstream end of the return path 16 open into the internal space of the accumulation container 12*a* at a certain height. That is, the return path 16 communicates with the suction path 14 via the internal space of the accumulator 12. It should be noted that another member such as a baffle may be provided inside the accumulation container 12*a* in order to reliably prevent the liquid refrigerant from entering the suction path 14 directly from the introduction pipe 12*b*. In addition, the downstream end of the return path 16 may be connected to the introduction pipe 12*b*.

Figure 2A:
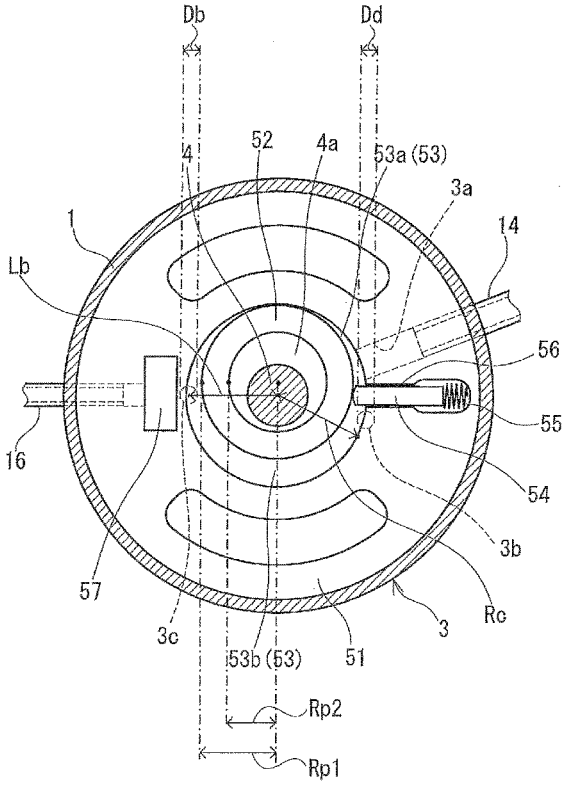
FIG. 2A is a transverse cross-sectional view taken along a IIA-IIA line of FIG. 1.

The compression mechanism 3 is a positive displacement fluid mechanism, and is moved by the motor 2 so as to draw in the refrigerant through the suction port 3*a*, compress the refrigerant, and discharge the refrigerant through a discharge port 3*b*. As shown in FIG. 1 and FIG. 2A, the compression mechanism 3 is composed of a cylinder 51, a piston 52, a vane 54, a spring 55, an upper sealing member 61, and a lower sealing member 62. The cylinder 51 is fixed to the inner circumferential surface of the closed casing 1. The piston 52 fitted to an eccentric portion 4*a* of the shaft 4 is disposed inside the cylinder 51 so as to form the working chamber 53 between the outer circumferential surface of the piston 52 and the inner circumferential surface of the cylinder 51. A vane groove 56 is formed in the cylinder 51. The vane 54 having one end that contacts the outer circumferential surface of the piston 52 is placed in the vane groove 56. The spring 55 is disposed in the vane groove 56 so as to push the vane 54 toward the piston 52. The working chamber 53 between the cylinder 51 and the piston 52 is divided by the vane 54, and thus a suction chamber 53*a* and a compression-discharge chamber 53*b* are formed. It should be noted that the vane 54 may be integrated with the piston 52. That is, the piston 52 and the vane 54 may be configured in the form of a swing piston. The upper sealing member 61 and the lower sealing member 62 seal both sides of the working chamber 53 in the axial direction of the shaft 4. In addition, the upper sealing member 61 and the lower sealing member 62 also function as bearings by which the shaft 4 is rotatably supported.

Figure 2B:
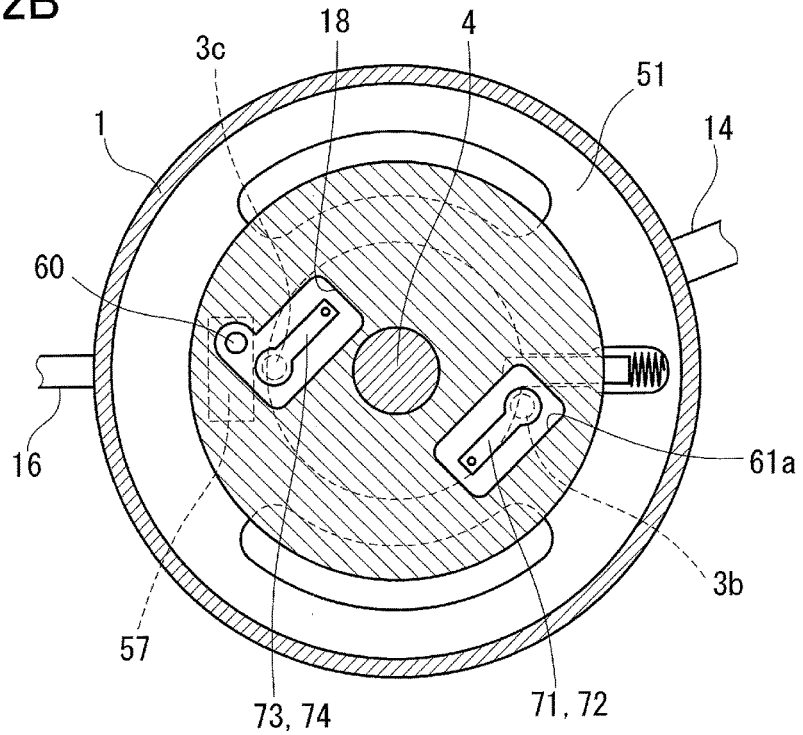
FIG. 2B is a transverse cross-sectional view taken along a IIB-IIB line of FIG. 1.

In the present embodiment, the suction port 3*a* through which the refrigerant to be compressed flows into the suction chamber 53*a* is provided in the cylinder 51, and the discharge port 3*b* through which the compressed refrigerant flows out of the compression-discharge chamber 53*b* is provided in the upper sealing member 61. The downstream end of the suction path 14 is connected to the suction port 3*a*. As shown in FIG. 2B, the upper sealing member 61 has a recess 61*a* formed in the upper surface of the upper sealing member 61 in the vicinity of the vane 54, and the discharge port 3*b* extends from the lower surface of the upper sealing member 61 to the bottom surface of the recess 61*a*. That is, the discharge port 3*b* opens into the internal space 28 of the closed casing 1. In addition, a discharge valve 71 that elastically deforms to open and close the discharge port 3*b*, and a stopper 72 that regulates the amount of deformation of the discharge valve 71, are disposed in the recess 61*a*.

Furthermore, a return port 3*c* through which the refrigerant is allowed to escape from the compression-discharge chamber 53*b*, and the back-pressure chamber 18 that communicates with the return port 3*c*, are provided in the upper sealing member 61. As shown in FIGS. 2A and 2B, the return port 3*c* is formed at a position that is 180 degrees opposite to the position of the vane 54 with respect to the axial center of the shaft 4. The back-pressure chamber 18 is composed of a recess formed in the upper surface of the upper sealing member 61 and a cap 63 covering the recess, and is separated from the internal space 28 of the closed casing 1. Furthermore, in the present embodiment, an intermediate chamber 57 sealed with the upper sealing member 61 and the lower sealing member 62 is provided in the cylinder 51, and the upstream end of the return path 16 opens into the intermediate chamber 57. A communication path 60 for allowing communication between the back-pressure chamber 18 and the intermediate chamber 57 is provided in the upper sealing member 61. In other words, the upstream end of the return path 16 is connected to the back-pressure chamber 18 via the intermediate chamber 57 and the communication path 60. However, the intermediate chamber 57 and the communication path 60 need not be provided, and the upstream end of the return path 16 may be connected to the back-pressure chamber 18 directly.

As shown in FIG. 1, a check valve 73 that elastically deforms to open and close the return port 3*c*, and a stopper 74 that regulates the amount of deformation of the check valve 73, are disposed in the back-pressure chamber 18. Specifically, the check valve 73 is a reed valve made of a thin metal plate and having an elongated shape. The check valve 73 blocks the flow of the refrigerant from the back-pressure chamber 18 to the working chamber 53. By using the check valve 73, the flow of the refrigerant from the back-pressure chamber 18 to the working chamber 53 can be blocked with a relatively simple structure without resorting to electric control.

A volume-varying valve 17 is provided in the return path 16, and is located outside the compressor body 40. The volume-varying valve 17 and the check valve 73 constitute a volume-varying mechanism. In the present embodiment, an on-off valve is used as the volume-varying valve 17. That is, in the present embodiment, the volume-varying mechanism has no ability to reduce the pressure of the refrigerant. In addition, the refrigerant having been drawn into the suction chamber 53*a* can be returned to the suction path 14 through the back-pressure chamber 18 and the return path 16, substantially without being compressed in the compression-discharge chamber 53*b*. Therefore, the reduction in efficiency due to pressure loss is very small. However, the volume-varying mechanism may have the ability to reduce the pressure of the refrigerant to the extent that the efficiency of the rotary compressor 100 is not largely affected. For a similar reason, the refrigerant having been compressed to some degree in the compression-discharge chamber 53*b* may be returned to the suction path 14 through the back-pressure chamber 18 and the return path 16.

The volume-varying valve 17 functions to vary the suction volume (confined volume) of the rotary compressor 100. When the suction volume of the rotary compressor 100 should be set relatively small, the volume-varying valve 17 is opened to allow the refrigerant to flow through the return path 16. On the other hand, when the suction volume of the rotary compressor 100 should be set relatively large, the volume-varying valve 17 is closed to preclude the refrigerant from flowing through the return path 16, and thus to increase the pressure inside the back-pressure chamber 18. While the volume-varying valve 17 is open, the rotary compressor 100 is operated in a low volume mode. While the volume-varying valve 17 is closed, the rotary compressor 100 is operated in a high volume mode.

When controlling the volume-varying valve 17 to switch the operation mode of the rotary compressor 100 from the high volume mode to the low volume mode, the controller 44 controls inverter 42 so as to compensate for a decrease in the suction volume with an increase in the rotational speed of the motor 2. This can prevent extreme decrease in the rotational speed of the motor 2 even when a low power is required (even when the load is small). That is, even when a low power is required, the motor 2 can be driven at a rotational speed that allows for high efficiency. Consequently, the efficiency of the rotary compressor 100 is also improved.

In the following of the present specification, the position of the vane 54 and the vane groove 56 is defined as a reference position located at "0 degrees" in the rotational direction of the shaft 4. In other words, the rotational angle of the shaft 4 at the moment when the vane 56 is maximally pushed into the vane groove 54 by the piston 52 is defined as "0 degrees".

In the high volume mode, a process for compressing the refrigerant confined in the compression-discharge chamber 53*b* (a compression process) starts from the time when the rotational angle is 0 degrees. On the other hand, in the low volume mode, a process for allowing the refrigerant confined in the compression-discharge chamber 53*b* to escape through the return port 3*c* is carried out during the period in which the rotational angle varies from 0 degrees to 180 degrees, and the compression process starts from the time when the rotational angle is 180 degrees. Therefore, assuming that the suction volume in the high volume mode is V, the suction volume in the low volume mode is about V/2. It should be understood that the position of the return port 3*c* or the like can be changed as appropriate depending on the rate of change of the suction volume. For example, in the case where the return port 3*c* is formed at a position corresponding to 90 degrees, the suction volume in the low volume mode is $\{1+(1/2)^{1/2}\}V/2$.

Next, the operation of the compression mechanism 3 will be described with reference to FIG. 3.

Figure 3:
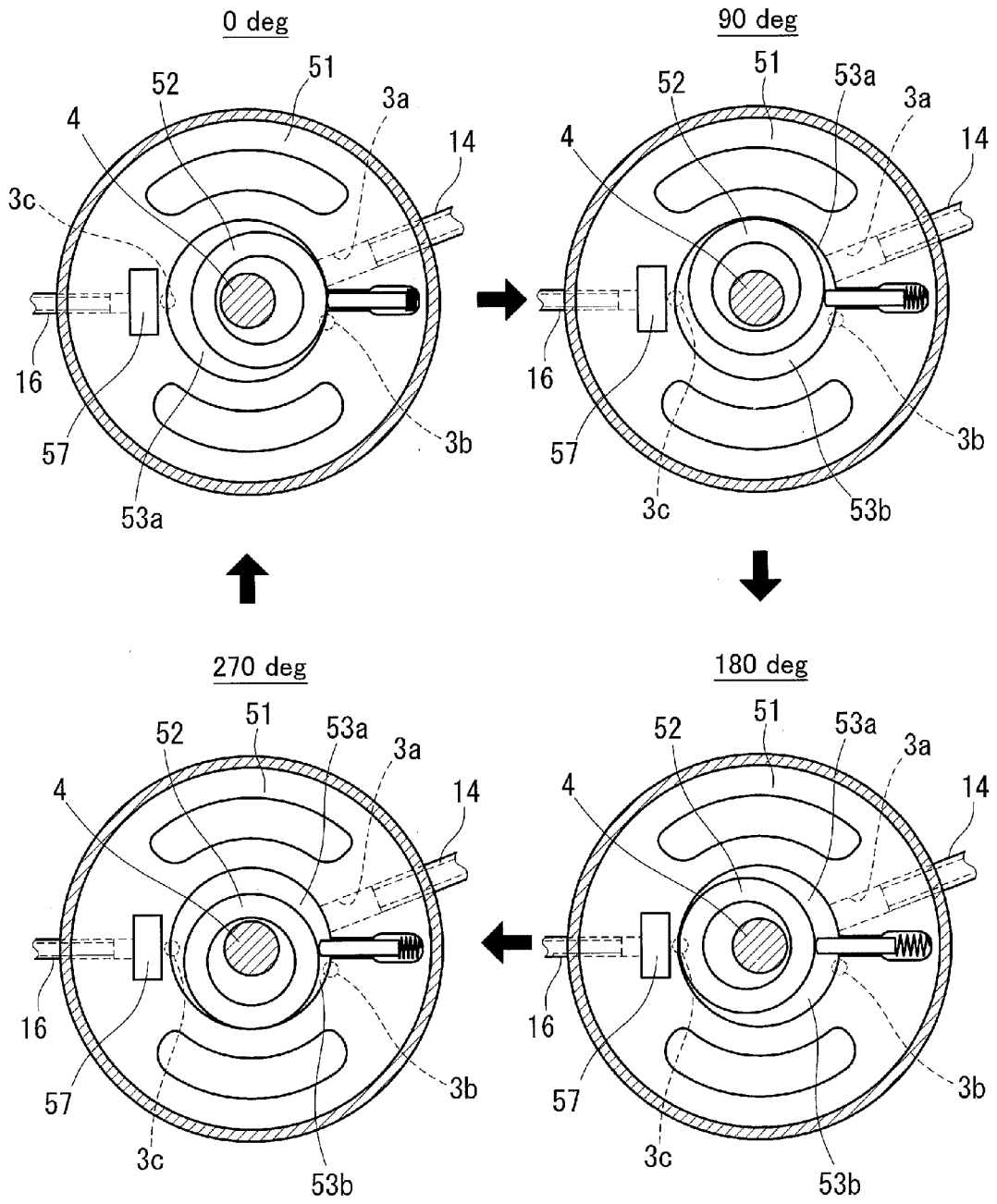
FIG. 3 is a diagram illustrating the operation principle of the rotary compressor of FIG. 1.
Figure 4A:
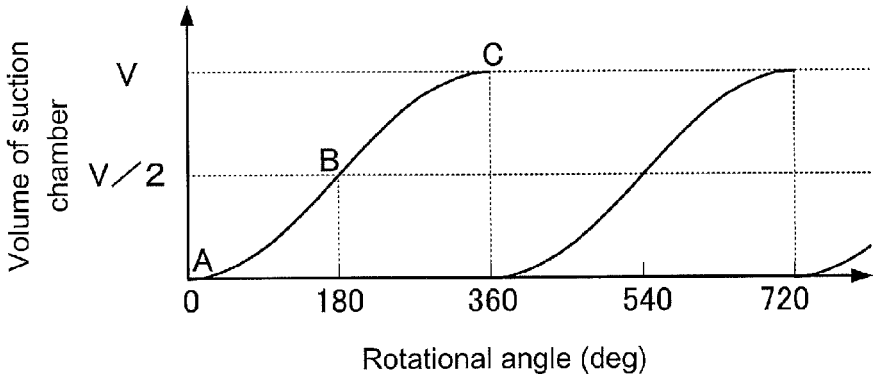
FIG. 4A is a graph showing the relationship between the rotational angle of a shaft and the volume of a suction chamber.
Figure 4B:
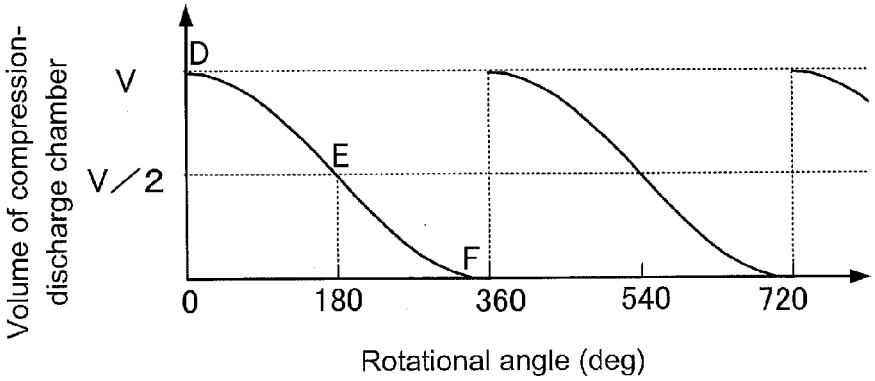
FIG. 4B is a graph showing the relationship between the rotational angle of the shaft and the volume of a compression-discharge chamber.

FIG. 3 shows the shaft 4 and the piston 52 which are rotating counterclockwise. The volume of the suction chamber 53*a* increases with the rotation of the shaft 4. As shown in the upper left of FIG. 3, the volume of the suction chamber 53*a* becomes maximum at the moment when the shaft 4 completes one rotation. Thereafter, the suction chamber 53*a* is converted to the compression-discharge chamber 53*b*. The volume of the compression-discharge chamber 53*b* decreases with the rotation of the shaft 4. As shown in FIGS. 4A and 4B, as the volume of the suction chamber 53*a* increases through points A, B, and C, the volume of the compression-discharge chamber 53*b* decreases through points D, E, and F.

As shown in the upper right of FIG. 3, while the volume-varying valve 17 is open, the check valve 73 deforms with decrease in the volume of the compression-discharge chamber 53*b*, and the refrigerant is discharged to the outside of the compression-discharge chamber 53*b* through the return port 3*c*. The discharged refrigerant is returned to the suction path 14 through the back-pressure chamber 18 and the return path 16. Therefore, the pressure of the compression-discharge chamber 53*b* is not increased. As shown in the lower right of FIG. 3, when the rotational angle of the shaft 4 reaches 180 degrees, the compression-discharge chamber 53*b* is disconnected from the return port 3*c*, and the refrigerant begins to be compressed in the compression-discharge chamber 53*b*. That is, the suction volume of the compression mechanism 3 is "V/2". The compression process continues until the pressure of the compression-discharge chamber 53*b* reaches the pressure of the internal space 28 of the closed casing 1. After the pressure of the compression-discharge chamber 53*b* has reached the pressure of the internal space 28, the discharge process is performed until the rotational angle of the shaft 4 reaches 360 degrees (0 degrees). As shown in the lower left and the upper left of FIG. 3, the volume of the compression-discharge chamber 53*b* becomes zero at the moment when the shaft 4 completes one rotation.

While the volume-varying valve 17 is closed, the return port 3*c* is closed by the check valve 73. Therefore, the suction volume of the compression mechanism 3 is "V", and the compression process starts immediately after the end of the suction process. At this time, the portions of the back-pressure chamber 18 and the return path 16 that are located upstream of the volume-varying valve 17 (hereinafter, these portions are collectively referred to as a "back-pressure space") have a relatively high pressure. This is because while the volume-varying valve 17 is closed, the refrigerant compressed up to an intermediate pressure is gradually accumulated in the back-pressure space. When the pressure of the compression-discharge chamber 53*b* is lower than the pressure of the back-pressure space, the check valve 73 prevents the refrigerant from flowing back to the working chamber 53 from the back-pressure chamber 18. That is, since the check valve 73 is provided on the working chamber 53 side with respect to the volume-varying valve 17, it is possible to avoid a situation where the entire back-pressure space acts as a dead volume.

In the meantime, while the volume-varying valve 17 is closed, the return port 3*c* acts as a dead volume Vd. The dead volume Vd is a factor that reduces the efficiency of the compressor while the volume-varying valve 17 is closed. Although the pressure of the refrigerant present in the return port 3*c* increases with progression of the compression process in the compression mechanism 3, the refrigerant is not discharged by the piston 52 to the outside of the working chamber 53, and the increased pressure is reduced when the suction process is performed again. This results in extra power consumption for compression. In view of the efficiency of the compressor during the period in which the volume-varying valve 17 is closed, the dead volume Vd is desirably as small as possible.

In the present embodiment, since the check valve 73 is placed in the upper sealing member 61 that is in contact with an end face of the piston 52, the length Lv of the return port 3*c* can be minimized. Therefore, the dead volume Vd can be made extremely small. On the other hand, while the volume-varying valve 17 is open, the return port 3*c* serves as a refrigerant flow path. The cross-section of the flow path is desirably as large as possible in order to reduce the flow resistance.

In general, the magnitude relationship between a diameter Ds of the suction port 3*a* and a diameter Dd of the discharge port 3*b* is determined in relation to the density of the drawn-in refrigerant and the density of the discharged refrigerant under rated conditions (typical conditions used for device design). For example, in the case of an air conditioner, the ratio of the density of the discharged refrigerant to the density of the drawn-in refrigerant is about 53 under the rated conditions, although depending on the performance of the air conditioner. Accordingly, the diameter Ds of the suction port 3*a* and the diameter Dd of the discharge port 3*b* are set so that the relation Ds=(53)0.5×Dd is satisfied.

In the case where the refrigerant passes through the return port 3*c*, the refrigerant passes through the return port 3*c* almost without being compressed. Therefore, the density of the refrigerant passing through the return port 3*c* is almost equal to the density of the drawn-in refrigerant. Accordingly, in view of the flow resistance, a diameter Db of the return port 3*c* is desirably set approximately equal to the diameter Ds of the suction port 3*a*. However, as a result of analytical and experimental studies of the influence of the dead volume Vd on the performance of the compressor and the influence of the flow resistance of the return port 3*c* having the diameter Db on the performance of the compressor, the inventors of the present invention have found that the performance of the compressor can be maintained at the most efficient level by setting the diameter Db of the return port 3*c* to be equal to or less than the diameter Dd of the discharge port (Db≤Dd).

In addition, when the diameter Db of the return port 3*c* is set equal to or less than the diameter Dd of the discharge port 3*b*, the check valve 73 for the return port 3*c* and the discharge valve 71 for the discharge port 3*b* can be configured in the same manner. This can achieve cost reduction of the compressor.

Furthermore, the diameter Db of the return port 3*c* may be set so that the diameter Db, an outer radius Rp1 of the piston 52, and an inner radius Rp2 of the piston 52 satisfy the relation Db<Rp1−Rp2. Such a configuration allows an end face (functioning as a sealing portion) of the piston 52 to seal the entire return port 3*c*. Therefore, increase in the number of ways the working fluid leaks in the high volume mode can be prevented. That is, for example, it is possible to prevent the working fluid from leaking downstream through the return port 3*c* during the compression process.

In addition, it is advantageous that a distance Lb between the center of the return port 3*c* and the center of the inner diameter of the cylinder 51 be set so that the distance Lb and an inner radius Rc of the cylinder 51 satisfy the relation $Rc-Db/2<Lb<Rc$. Such a configuration makes it possible to increase the sealing length between the return port 3*c* and a high-temperature high-pressure lubricating oil present in an inner portion of the piston 52. Therefore, the amount of the high-temperature high-pressure lubricating oil seeping into the return port 3*c* via the end face of the piston 52 can be reduced, and excessive degree of heat reception by the drawn-in working fluid can be prevented. In addition, since a half or larger area of the return port 3*c* faces the working chamber 53 of the cylinder 51, the flow resistance can be reduced without disturbance of the flow of the working fluid.

Next, the steps performed by the controller 44 to control the volume-varying valve 17 and the inverter 42 will be described with reference to FIG. 5.

In step S1, the rotational speed of the motor 2 is adjusted based on a required power. Specifically, the rotational speed of the motor 2 is adjusted so as to obtain a required refrigerant flow rate. Next, in step S2 and step S6, it is determined whether the rotational speed of the motor 2 has been increased or decreased. When the process of decreasing the rotational speed has been performed in step S1, the control proceeds to step S3, and it is determined whether the current rotational speed is equal to or lower than 30 Hz. If the current rotational speed is equal to or lower than 30 Hz, it is determined in step S4 whether the volume-varying valve 17 is closed. If the volume-varying valve 17 is closed, the process of opening the volume-varying valve 17 and the process of increasing the rotational speed of the motor 2 to a rotational speed which is twice the current rotational speed, are performed in step S5. The order of the processes in step S5 is not particularly limited. The rotational speed of the motor 2 can be increased almost at the same time as the volume-varying valve is caused to open.

On the other hand, when the process of increasing the rotational speed has been performed in step S1, the control proceeds to step S7, and it is determined whether the current rotational speed is equal to or higher than 70 Hz. If the current rotational speed is equal to or higher than 70 Hz, it is determined in step S8 whether the volume-varying valve 17 is open. If the volume-varying valve 17 is open, the process of closing the volume-varying valve 17 and the process of decreasing the rotational speed of the motor 2 to a rotational speed which is ½ times the current rotational speed, are performed in step S9. The order of the processes in step S9 is not particularly limited. The rotational speed of the motor 2 can be decreased almost at the same time as the volume-varying valve 17 is caused to close.

Figure 5:
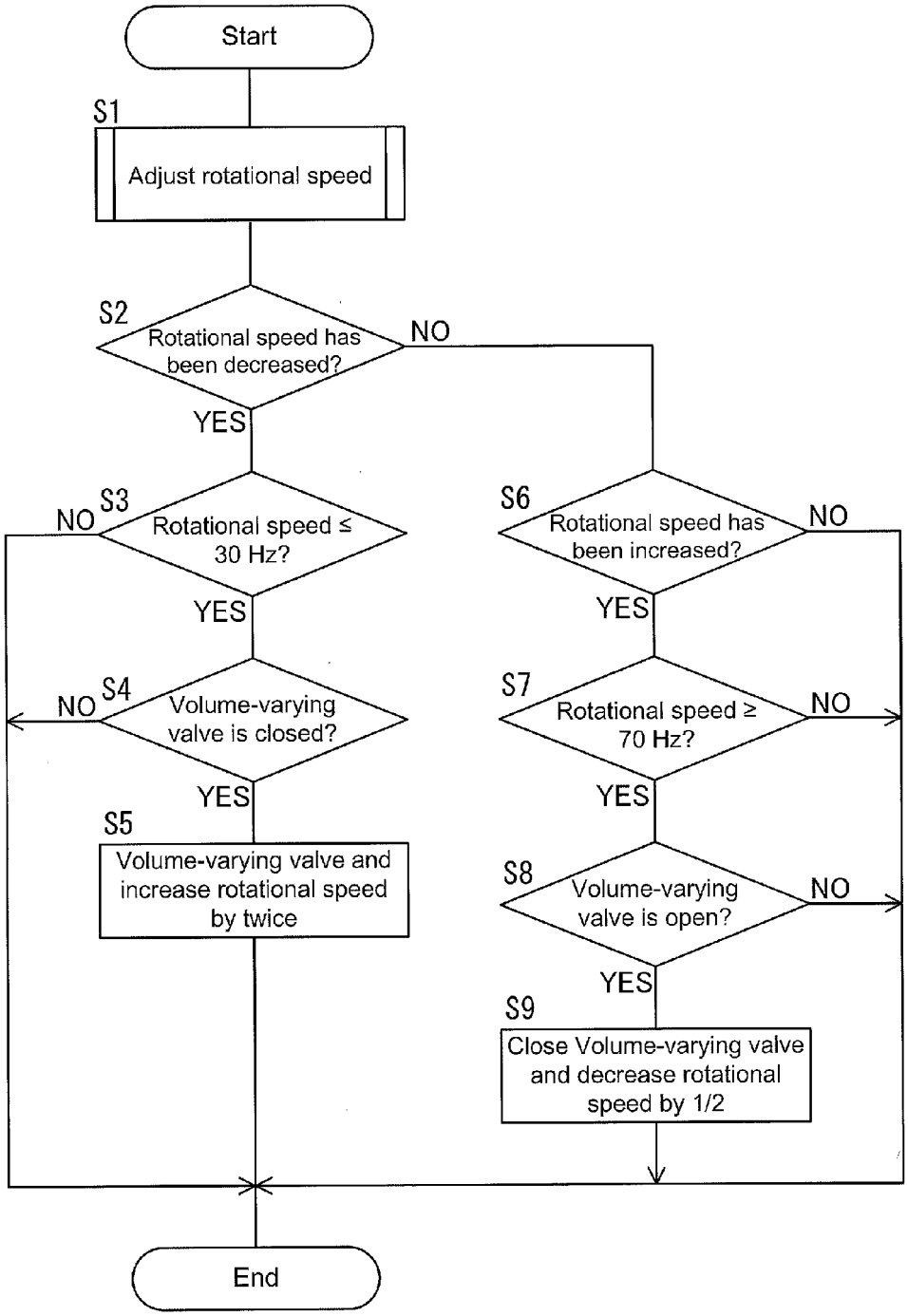
FIG. 5 is a flowchart illustrating control of a volume-varying mechanism (on-off valve) and an inverter.
Figure 6:
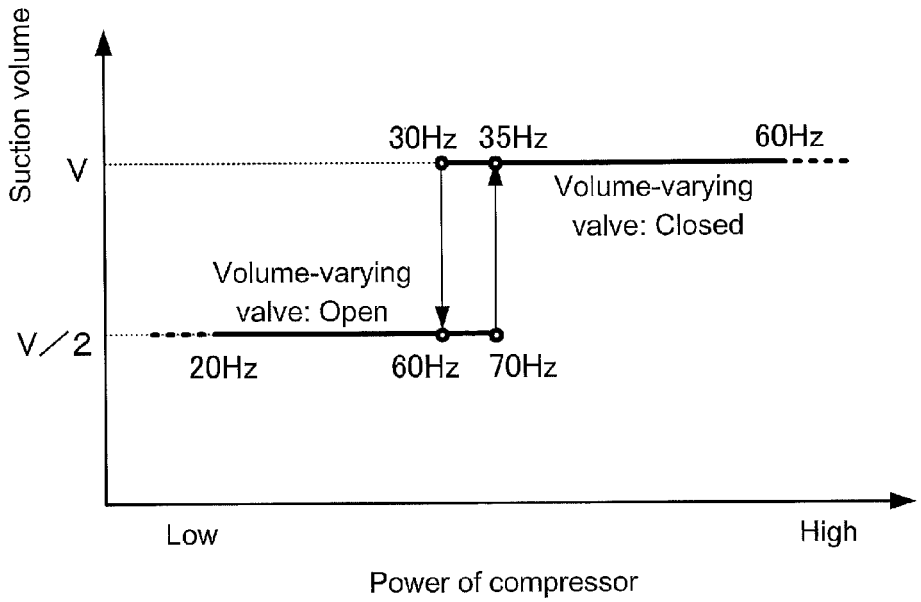
FIG. 6 is a graph showing the relationship among the power of the rotary compressor, the suction volume of a compression mechanism, the state of the on-off valve, and the rotational speed of a motor.

When the control is performed in accordance with the flowchart of FIG. 5, the relationship between the state of the volume-varying valve 17 and the rotational speed of the motor 2 has a hysteresis as shown in FIG. 6. Such control allows prevention of hunting of the compression mechanism 3.

In the state where the volume-varying valve 17 is closed, that is, in the high volume mode in which the refrigerant is precluded from flowing through the return path 16, the suction volume of the compression mechanism 3 is "V". If the rotational speed of the motor 2 decreases from a high rotational speed to a first rotational speed (e.g., 30 Hz) or lower during the operation in the high volume mode, the controller 44 performs a process for the volume-varying valve 17 to decrease the suction volume, and also performs a process for the inverter 42 to increase the rotational speed of the motor 2. The process performed for the volume-varying valve 17 to decrease the suction volume is the process of opening the volume-varying valve 17. The process performed for the inverter 42 to increase the rotational speed of the motor 2 is the process of setting the target rotational speed of the motor 2 to a rotational speed which is twice the latest rotational speed.

In addition, the controller 44 controls the volume-varying valve 17 and the inverter 42 so as to compensate for an increase in the suction volume with a decrease in the rotational speed of the motor 2. In the state where the volume-varying valve 17 is open, that is, in the low volume mode in which the refrigerant is allowed to flow through the return path 16, the suction volume of the compression mechanism 3 is "V/2". If the rotational speed of the motor 2 increases to a second rotational speed (e.g., 70 Hz) or higher during the operation in the low volume mode, the controller 44 performs a process for the volume-varying valve 17 to increase the suction volume, and also performs a process for the inverter 42 to decrease the rotational speed of the motor 2. The process performed for the volume-varying valve 17 to increase the suction volume is the process of closing the volume-varying valve 17. The process performed for the inverter 42 to decrease the rotational speed of the motor 2 is the process of setting the target rotational speed of the motor 2 to a rotational speed which is ½ times the latest rotational speed.

As shown in FIG. 6, when the rotational speed of the motor 2 decreases to 30 Hz while the volume-varying valve 17 is closed, the volume-varying valve 17 is caused to open, and the rotational speed of the motor 2 is increased to 60 Hz. When the rotational speed of the motor 2 increases to 70 Hz while the volume-varying valve 17 is open, the volume-varying valve 17 is caused to close, and the rotational speed of the motor 2 is decreased to 35 Hz. Assuming that the rotational speed at the time of opening the volume-varying valve 17 and increasing the rotational speed of the motor 2 is defined as a third rotational speed, and that the rotational speed at the time of closing the volume-varying valve 17 and decreasing the rotational speed of the motor 2 is defined as a fourth rotational speed, the following relations are satisfied: (the first rotational speed)<(the fourth rotational speed); and (the third rotational speed)<(the second rotational speed). For example, when the first rotational speed is set to a rotational speed equal to or lower than 30 Hz, the rotary compressor 100 can be operated with a broader range of power. The lower limit of the first rotational speed is not particularly limited, and is, for example, 20 Hz.

When the operation mode is switched, the rotational speed of the motor 2 can be adjusted in accordance with (VL/VH) which is the ratio of a suction volume VL in the low volume mode to a suction volume VH in the high volume mode. When the operation mode is switched from the high volume mode to the low volume mode, the rotational speed (target rotational speed) of the motor 2 is set to a rotational speed that results from dividing the rotational speed of the motor 2 immediately before the mode switching by the ratio (VL/VH). Similarly, when the operation mode is switched from the low volume mode to the high volume mode, the rotational speed of the motor 2 is set to a rotational speed that results from multiplying the rotational speed of the motor 2 immediately before the mode switching by the ratio (VL/VH). This allows smooth switching of the operation mode between the high volume mode and the low volume mode.

It should be noted that 100% of a decrease in the power of the rotary compressor 100 caused by a decrease in the suction volume need not necessarily be compensated for with an increase in the power of the rotary compressor 100 achieved by an increase in the rotational speed of the motor 2. In the example shown in FIG. 6, when the suction volume is decreased by ½ by opening the volume-varying valve 17, the rotational speed of the motor 2 is increased by twice. Therefore, the power of the rotary compressor 100 is not changed by the mode switching. However, no particular problem arises even if the power of the rotary compressor 100 is increased or decreased because of the mode switching.

Next, another example of the steps of control of the volume-varying valve 17 and the inverter 42 will be described.

The controller 44 may be configured to perform a process for the volume-varying valve 17 to decrease the suction volume, and perform a process for the inverter 42 to increase the rotational speed of the motor 2 when the flow rate of the refrigerant is excessive even if the rotational speed of the motor 2 is decreased to the first rotational speed (e.g., 30 Hz) in the high volume mode. That is, the controller 44 may be configured to determine the need for mode switching before the rotational speed of the motor 2 is actually decreased to the first rotational speed. Similarly, the controller 44 may be configured to perform a process for the volume-varying valve 17 to increase the suction volume, and perform a process for the inverter 42 to decrease the rotational speed of the motor 2 when the flow rate of the refrigerant is insufficient even if the rotational speed of the motor 2 is increased to the second rotational speed (e.g., 70 Hz) in the low volume mode. That is, the controller 44 may be configured to determine the need for mode switching before the rotational speed of the motor 2 is actually increased to the second rotational speed. An example of such control will be described with reference to FIG. 7.

Figure 7:
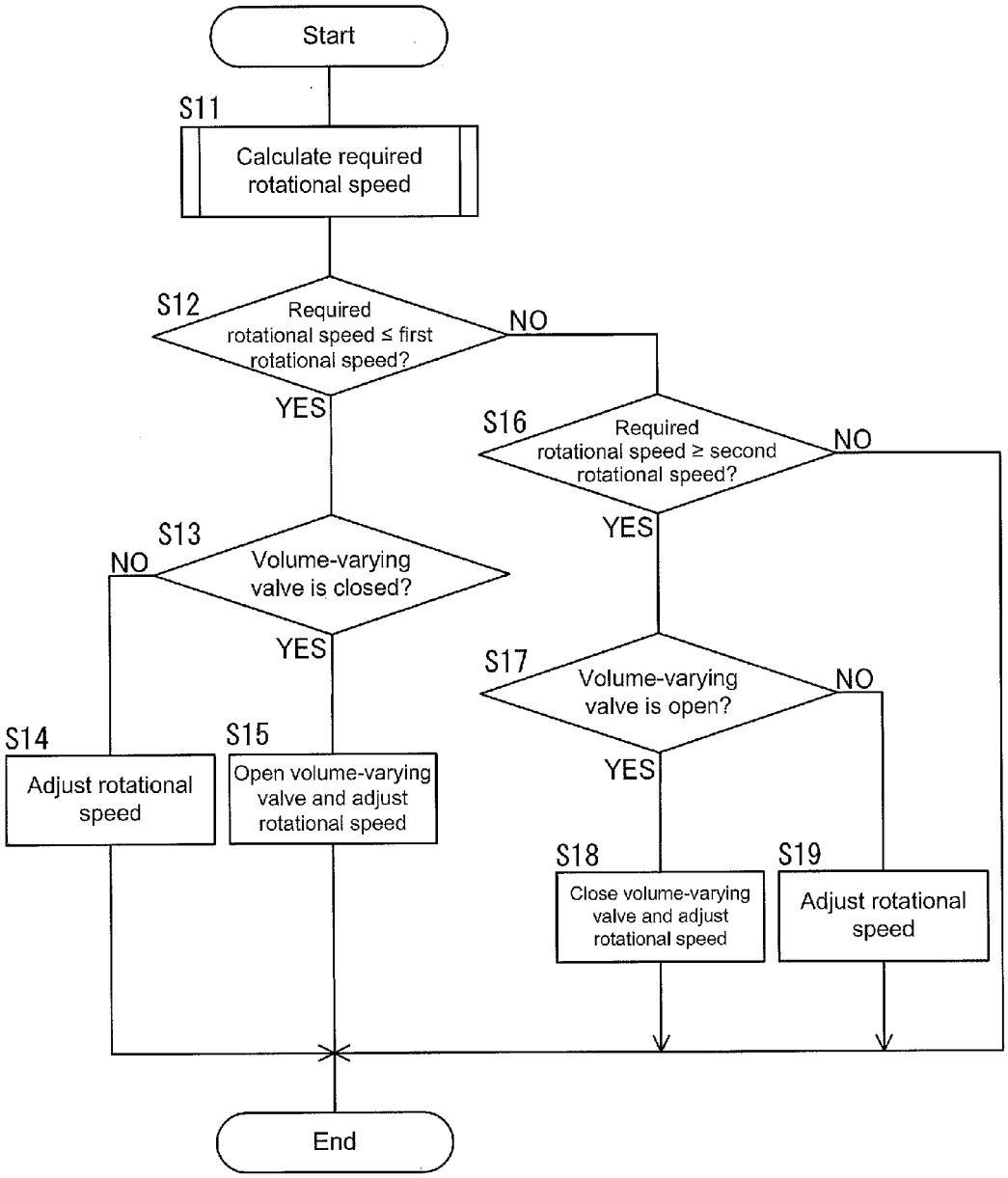
FIG. 7 is another flowchart illustrating control of the volume-varying mechanism (on-off valve) and the inverter.

As shown in FIG. 7, a required rotational speed of the motor 2 is calculated in step S11 first. The "required rotational speed" means, for example, a rotational speed for obtaining a required refrigerant flow rate. Next, in step S12, it is determined whether the required rotational speed is equal to or lower than the first rotational speed (e.g., 30 Hz). If the required rotational speed is equal to or lower than the first rotational speed, it is determined in step S13 whether the volume-varying valve 17 is closed. If the volume-varying valve 17 is closed, in step S15, the volume-varying valve 17 is caused to open, and the rotational speed of the motor 2 is adjusted to a rotational speed that allows the required refrigerant flow rate to be obtained. If the volume-varying valve 17 is open, only the rotational speed of the motor 2 is adjusted in step S14.

On the other hand, if the required rotational speed is higher than the first rotational speed, it is determined in step S16 whether the required rotational speed is equal to or higher than the second rotational speed (e.g., 70 Hz). If the required rotational speed is equal to or higher than the second rotational speed, it is determined in step S17 whether the volume-varying valve 17 is open. If the volume-varying valve 17 is open, in step S18, the volume-varying valve 17 is caused to close, and the rotational speed of the motor 2 is adjusted to a rotational speed that allows the required refrigerant flow rate to be obtained. If the volume-varying valve 17 is closed, only the rotational speed of the motor 2 is adjusted in step S19.

Figure 8:
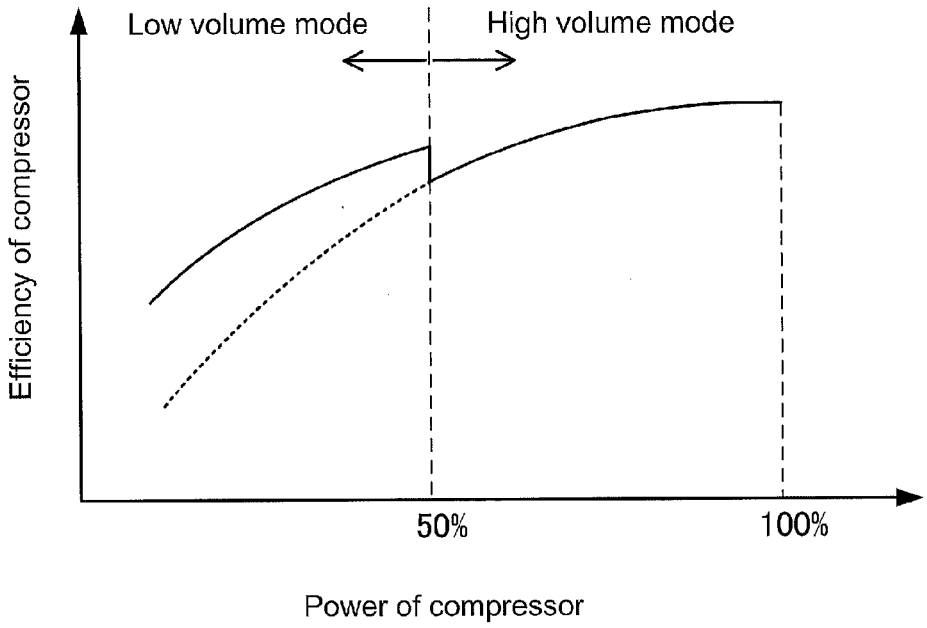
FIG. 8 is a graph showing the relationship between the power of the rotary compressor and the efficiency of the rotary compressor.

Performing the control described with reference to FIG. 5 or FIG. 7 allows the rotary compressor 100 to exhibit high efficiency even when a low power is required (even when the load is small), as shown by a solid line in FIG. 8. In FIG. 8, the rated power of the rotary compressor 100 is "100%". When the rated power is defined as a reference, the efficiency of the rotary compressor 100 decreases with reduction in the power to be exerted, that is, with reduction in the rotational speed of the motor 2. As shown by a dashed line, the reduction in efficiency is significant when the motor 2 is driven at a rotational speed which is 50% or less of the rated rotational speed. In the present embodiment, when a relatively low power is required, the operation is performed in the low volume mode in which the suction volume is V/2. This allows the motor 2 to be driven at a rotational speed which is as close to the rated rotational speed as possible. Accordingly, the rotary compressor 100 can exhibit excellent efficiency even when the required power is 50% or less of the rated power.

Next, a description will be given of the effect that is obtained based on the fact that the return path 16 communicates with the suction path 14 via the internal space of the accumulator 12.

Figure 9A:
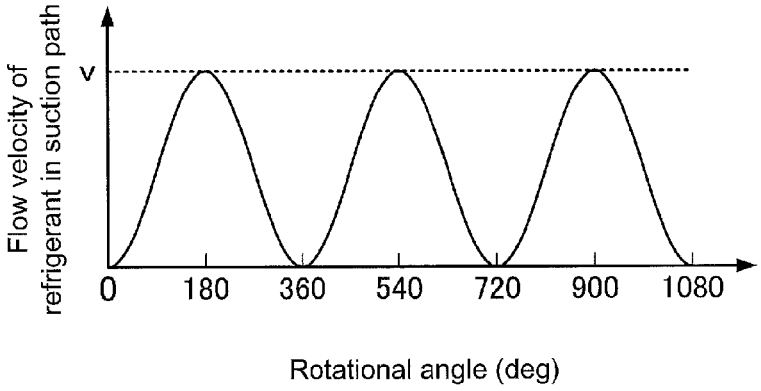
FIG. 9A is a graph showing the relationship between the rotational angle of the shaft and the flow velocity of a refrigerant in a suction path.

Basically, all of the refrigerant present in the suction path 14 is drawn into the suction chamber 53*a*. Therefore, as shown in FIG. 9A, the flow velocity of the refrigerant in the suction path 14 varies in proportion to the change rate of the volume of the suction chamber 53*a* (see FIG. 4A). Specifically, the flow velocity of the refrigerant in the suction path 14 shows, in theory, a sine wave profile with respect to the rotational angle of the shaft 4.

Figure 9B:
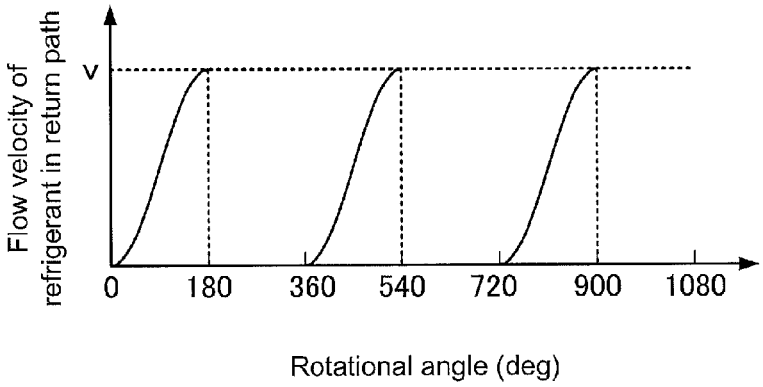
FIG. 9B is a graph showing the relationship between the rotational angle of the shaft and the flow velocity of the refrigerant in a return path.

In the case where the volume-varying valve 17 is open, the refrigerant in the compression-discharge chamber 53*b* is discharged to the back-pressure chamber 18 through the return port 3*c* during the period in which the rotational angle of the shaft 4 varies from 0 to 180 degrees. The amount of the refrigerant discharged to the back-pressure chamber 18 from the compression-discharge chamber 53*b* is equal to the amount of decrease in the volume of the compression-discharge chamber 53*b* during the period in which the rotational angle varies from 0 to 180 degrees. As shown in FIG. 9B, the flow velocity of the refrigerant in the return path 16 varies in proportion to the change rate of the volume of the compression-discharge chamber 53*b* (see FIG. 4B) only during the period in which the rotational angle of the shaft 4 varies from 0 to 180 degrees. Specifically, in theory, the flow velocity of the refrigerant in the return path 16 shows a sine wave profile during the period in which the rotational angle varies from 0 to 180 degrees, and is zero during the period in which the rotation angle varies from 180 to 360 degrees.

Figure 9C:
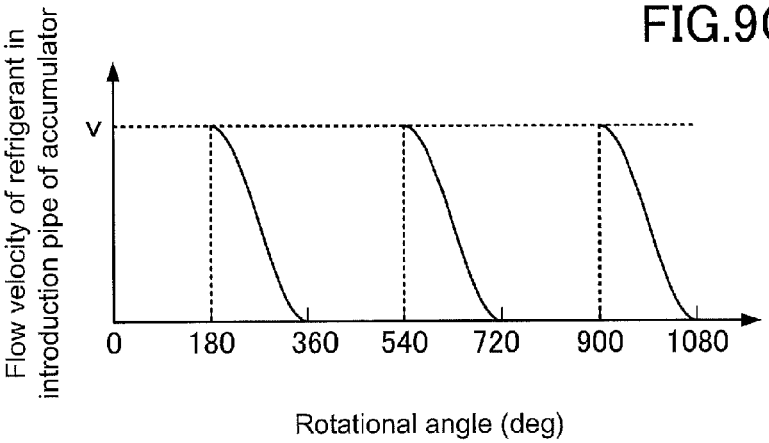
FIG. 9C is a graph showing the relationship between the rotational angle of the shaft and the flow velocity of the refrigerant in an introduction pipe of an accumulator.

The refrigerant flows into the accumulator 12 from both the introduction pipe 12*b* and the return path 16. The refrigerant having flowed into the accumulator 12 can advance only to the suction path 14. Therefore, the flow velocity of the refrigerant in the introduction pipe 12*b* of the accumulator 12 is approximately equal to the difference between the flow velocity of the refrigerant in the suction path 14 and the flow velocity of the refrigerant in the return path 16. Specifically, in theory, the flow velocity of the refrigerant in the introduction pipe 12*b* shows a sine wave profile during the period in which the rotational angle varies from 180 to 360 degrees, and is zero during the period in which the rotational angle varies from 0 to 180 degrees, as shown in FIG. 9C.

When the rotational angle of the shaft 4 reaches 180 degrees, the flow velocity of the refrigerant in the return path 16 rapidly drops from the maximum flow velocity v to zero. In addition, when the rotational angle of the shaft 4 reaches 180 degrees, the flow velocity of the refrigerant in the introduction pipe 12*b* rapidly increases from zero to the maximum flow velocity v. Such rapid change of the flow velocity may foster occurrence of water hammering, leading to problems such as reduction in reliability and occurrence of noise which are caused by vibration of pipes constituting the suction path 14 and the return path 16. Furthermore, a pressure wave transmitted to the suction path 14 may reduce the volume efficiency of the suction chamber 53*a*, thus resulting in reduction in the efficiency of the rotary compressor 100. However, in the present embodiment, the return path 16 communicates with the suction path 14 via the internal space of the accumulator 12. This configuration can prevent occurrence of water hammering, thereby making it possible to effectively reduce vibration, noise, and efficiency reduction.

Figure 10:
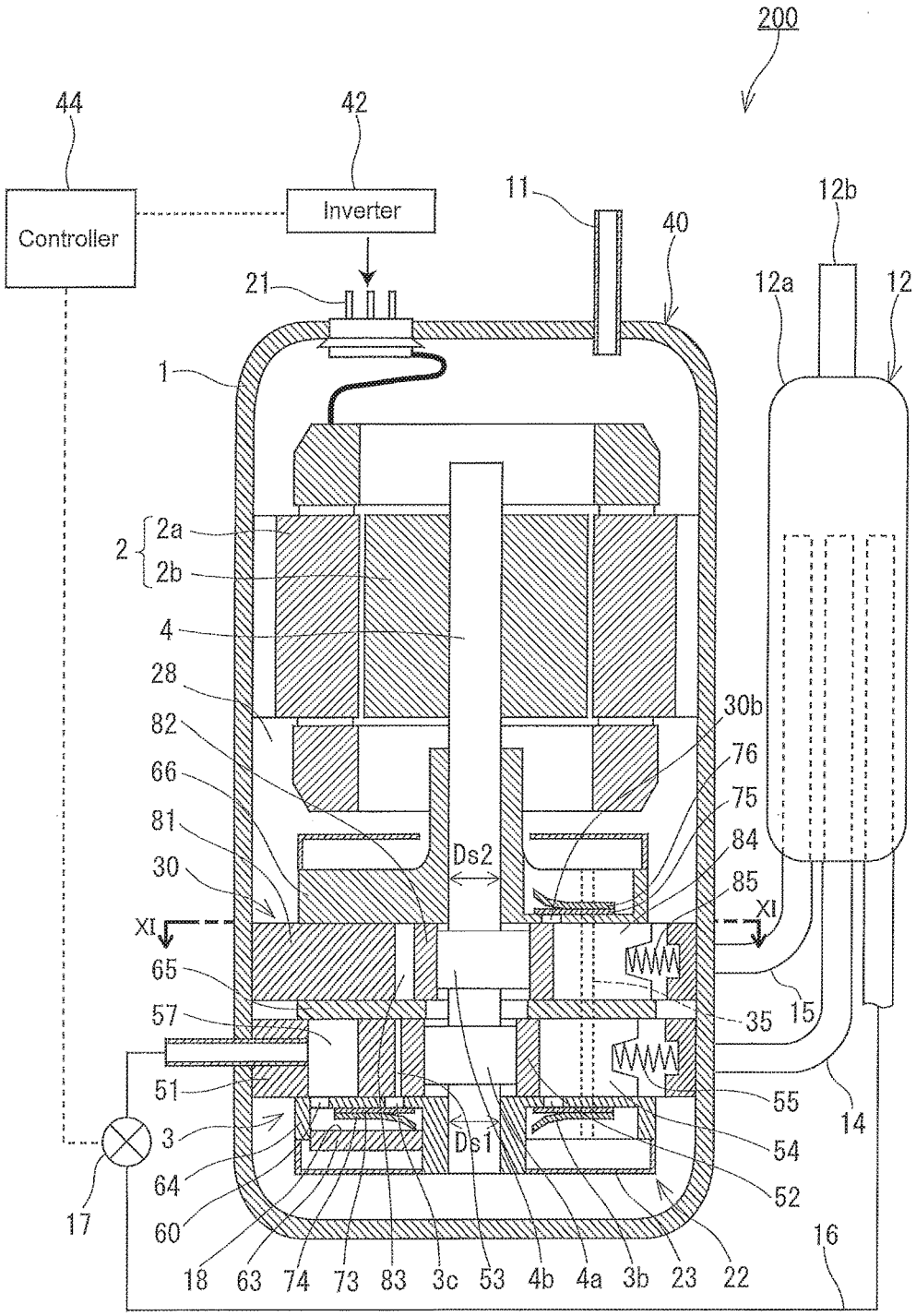
FIG. 10 is a longitudinal cross-sectional view of a rotary compressor according to a second embodiment of the present invention.

It should be noted that, although the return port 3*c* and the back-pressure chamber 18 are provided in the upper sealing member 61 in the present embodiment, the return port 3*c* and the back-pressure chamber 18 are preferably provided in the lower sealing member 62 (see FIG. 10 for reference). This is because such a configuration allows an lubricating oil to be accumulated in the return port 3*c* while the return port 3*c* is closed in the high volume mode, with the result that the dead volume can be reduced.

Second Embodiment

As shown in FIG. 10, a rotary compressor 200 of the present embodiment includes the compression mechanism 3 described in the first embodiment, and further includes a second compression mechanism 30 disposed above the compression mechanism 3. Hereinafter, the compression mechanism 3 and the components associated with the compression mechanism 3, which have been described in the first embodiment, will be represented by adding "first". For example, the cylinder 51, the piston 52, the vane 54, the working chamber 53, the compression mechanism 3, and the suction path 14, are represented as a first cylinder 51, a first piston 52, a first vane 54, a first working chamber 53, a first compression mechanism 3, and a first suction path 14, respectively.

In addition to the first eccentric portion 4*a*, a second eccentric portion 4*b* is provided in the shaft 4. The direction of eccentricity of the first eccentric portion 4*a* is different from the direction of eccentricity of the second eccentric portion 4*b* by 180 degrees. That is, the phase of the first piston 52 is different from the phase of a second piston 82 described later by 180 degrees in terms of the rotational angle of the shaft 4.

The second compression mechanism 30 is a positive displacement fluid mechanism, and is driven by the motor 2 so as to draw in a refrigerant through a second suction port 30*a*, compress the refrigerant, and discharge the refrigerant through a second discharge port 30*b*. The refrigerant is introduced from the internal space of the accumulator 12 into the second suction port 30*a* through a second suction path 15. In the present embodiment, no return port is provided in the second compression mechanism 30. Therefore, the suction volume of the second compression mechanism 30 keeps constant. It should be noted that one of the first suction path 14 and the second suction path 15 may be branched from the other inside or outside the accumulator 12.

Figure 11:
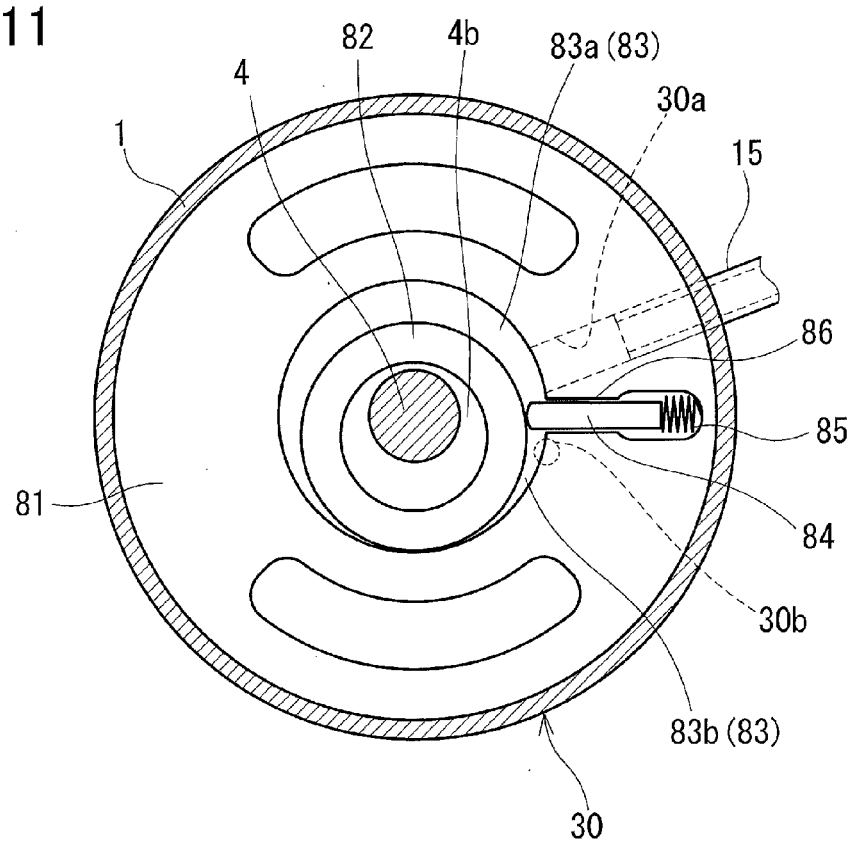
FIG. 11 is a transverse cross-sectional view taken along a XI-XI line of FIG. 10.

As shown in FIG. 10 and FIG. 11, the second compression mechanism 30 is composed of a second cylinder 81, a second piston 82, a second vane 84, a second spring 85, an intermediate plate 65, and a second sealing member 66. On the other hand, the first compression mechanism 3 has the intermediate plate 65 and a first sealing member 64, instead of the upper sealing member 61 and the lower sealing member 62 which have been described in the first embodiment. That is, the intermediate plate 65 is shared between the first compression mechanism 3 and the second compression mechanism 30. The intermediate plate 65 is sandwiched between the first cylinder 51 and the second cylinder 81, seals the upper side of the first working chamber 53, and seals the lower side of the second working chamber 83 described later. In addition, the first sealing member 64 seals the lower side of the first working chamber 53, while the second sealing member 66 seals the upper side of the second working chamber 83. The first sealing member 64 and the second sealing member 66 also function as bearings by which the shaft 4 is rotatably supported.

The second cylinder 81 is disposed concentrically with the first cylinder 51. The second piston 82 fitted to the second eccentric portion 4*b* of the shaft 4 is disposed inside the second cylinder 81 so as to form the second working chamber 83 between the outer circumferential surface of the second piston 82 and the inner circumferential surface of the second cylinder 81. A second vane groove 86 is formed in the second cylinder 81. The second vane 84 having one end that contacts the outer circumferential surface of the second piston 82 is placed in the second vane groove 86. The second spring 85 is disposed in the second vane groove 86 so as to push the second vane 84 toward the second piston 82. The second working chamber 83 between the second cylinder 81 and the second piston 82 is divided by the second vane 84, and thus a second suction chamber 83*a* and a second compression-discharge chamber 83*b* are formed. The second vane 84 is disposed at such a position that the second vane 84 is aligned with the first vane 54 in the axial direction of the shaft 4. Therefore, there is a time difference corresponding to 180 degrees between when the second piston 82 is at top dead center (a position at which the second piston 82 causes the second vane 84 to be retracted maximally) and when the first piston 52 is at top dead center (a position at which the first piston 52 causes the first vane 54 to be retracted maximally).

In the present embodiment, the second suction port 30*a* through which the refrigerant to be compressed flows into the second suction chamber 83*a* is provided in the second cylinder 81, and the second discharge port 30*b* through which the compressed refrigerant flows out of the second compression-discharge chamber 83*b* is provided in the second sealing member 66. The downstream end of the second suction path 15 is connected to the second suction port 30*a*. The second sealing member 66 has a recess formed in the upper surface of the second sealing member 66 in the vicinity of the second vane 84, and the discharge port 30*b* extends from the lower surface of the second sealing member 66 to the bottom surface of the recess. That is, the second discharge port 30*b* opens into the internal space 28 of the closed casing 1. In addition, a second discharge valve 75 that elastically deforms to open and close the discharge port 30*b*, and a stopper 76 that regulates the amount of deformation of the second discharge valve 75, are disposed in the recess.

On the other hand, in the first compression mechanism 3, the first discharge port 3*a*, the return port 3*c*, the back-pressure chamber 18, and the communication path 60 are provided in the first sealing member 64. The first sealing member 64 is covered with a muffler 23 having an internal space capable of receiving the refrigerant discharged through the discharge port 3*b*. In addition, a flow path 35 that penetrates through the first sealing member 64, the first cylinder 51, the intermediate plate 65, the second cylinder 81, and the second sealing member 66, is provided so that the refrigerant compressed by the first compression mechanism 3 moves from the internal space of the muffler 23 to the internal space 28 of the closed casing 1 through the flow path 35. The back-pressure chamber 18 is separated by the cap 63 from the internal space of the muffler 23, and also from the internal space 28 of the closed casing 1.

In the present embodiment, no return port is provided in the second compression mechanism 30. Therefore, only the suction volume of the first compression mechanism 3 can be varied. By thus allowing only the suction volume of the first compression mechanism 3 to be varied, the production cost of the rotary compressor 200 can be reduced.

Furthermore, in the present embodiment, the first compression mechanism 3 is located farther from the motor 2, and the second compression mechanism 33 is located nearer to the motor 2. That is, the motor 2, the second compression mechanism 30, and the first compression mechanism 3 are arranged in this order in the axial direction of the shaft 4. The second compression mechanism 30 has a constant suction volume, and thus requires a large load torque also in the low volume mode. Therefore, when the second compression mechanism 30 is located nearer to the motor 2 than the first compression mechanism 3, a load applied to the shaft 4 in the low volume mode is reduced, which can result in reduction in friction loss in the first sealing member 64 and the second sealing member 66 which function as bearings. In addition, when the first compression mechanism 3 having a small suction volume in the low volume mode is disposed at the lower position, it is possible to reduce pressure loss caused by the flow of the compressed refrigerant to the internal space 28 of the closed casing 1 through the internal space of the muffler 23 and the flow path 35. However, the positional relationship between the first compression mechanism 3 and the second compression mechanism 30 is not limited to the above relationship. The positions of the compression mechanisms may be reversed.

As described in the first embodiment, in the case where the return port 3*c* is formed at a position corresponding to 180 degrees, "V" or "V/2" can be selected as the suction volume of the first compression mechanism 3. Furthermore, when the suction volume of the second compression mechanism 30 is "V", "2V" or "1.5V" can be selected as the sum of the suction volumes of the first compression mechanism 3 and the second compression mechanism 30.

Figure 12:
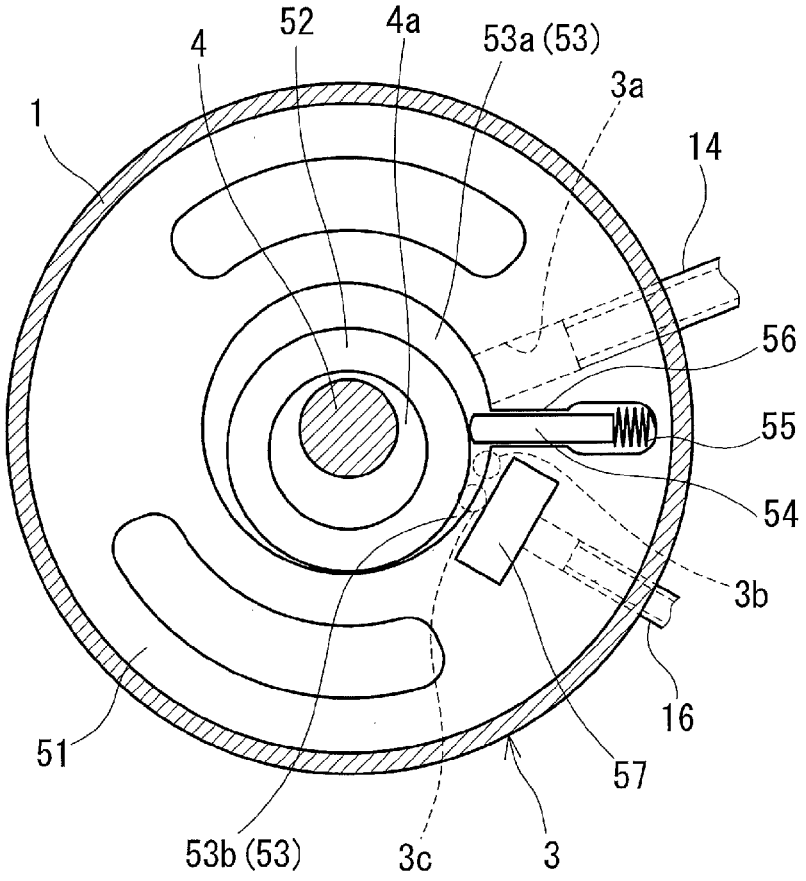
FIG. 12 is a transverse cross-sectional view showing another example of the position of a return port.

Meanwhile, in the low volume mode in which the refrigerant is allowed to flow through the return path 16, the suction volume of the first compression mechanism 3 can be made substantially zero. Specifically, as shown in FIG. 12, the return port 3*c* may be formed at a position in the vicinity of the first discharge port 3*b*. In the low volume mode in this configuration, almost all of the refrigerant drawn into the first suction chamber 53*a* is returned to the accumulator 12 through the back-pressure chamber 18 and the return path 16 without being compressed. That is, the function of the first compression mechanism 3 can be canceled. The sum of the suction volumes of the first compression mechanism 3 and the second compression mechanism 30 in the low volume mode is equal to the suction volume V of the second compression mechanism 30.

It should be noted that "making the suction volume of the first compression mechanism 3 substantially zero" does not necessarily mean that the suction volume of the first compression mechanism 3 is exactly zero. For example, when the suction volume in the high volume mode is V, the position of the return port 3*c* can be determined so that the suction volume in the low volume mode is less than $\{1-(1/2)^{1/2}\}V/2$, and preferably less than V/10. In the low volume mode in this configuration, the first compression mechanism 3 does not perform the work of compressing the refrigerant, and can be said to lose its function.

Furthermore, in the case where the suction volume of the first compression mechanism 3 in the low volume mode is made substantially zero, the first compression mechanism 3 is preferably disposed below the second compression mechanism 30 from the standpoint of the reliability of the bearings. In a configuration that includes two compression mechanisms as in the present embodiment, the lower part of the eccentric portion, which corresponds to an end portion of the shaft, is generally narrower than the upper part of the eccentric portion for convenience of mounting the piston to the shaft. That is, when the first compression mechanism 3 is disposed below the second compression mechanism 30, a diameter Ds1 of the portion of the shaft 4 that is supported by the first sealing member 64 is smaller than a diameter Ds2 of the portion of the shaft 4 that is supported by the second sealing member 66. Accordingly, the bearing capacity of the first sealing member 64 can be made smaller than the bearing capacity of the second sealing member 66, and a load applied to the shaft 4 in the low volume mode can be reduced, compared to the case where the first compression mechanism 3 is disposed above the second compression mechanism 30.

Third Embodiment

Figure 13:
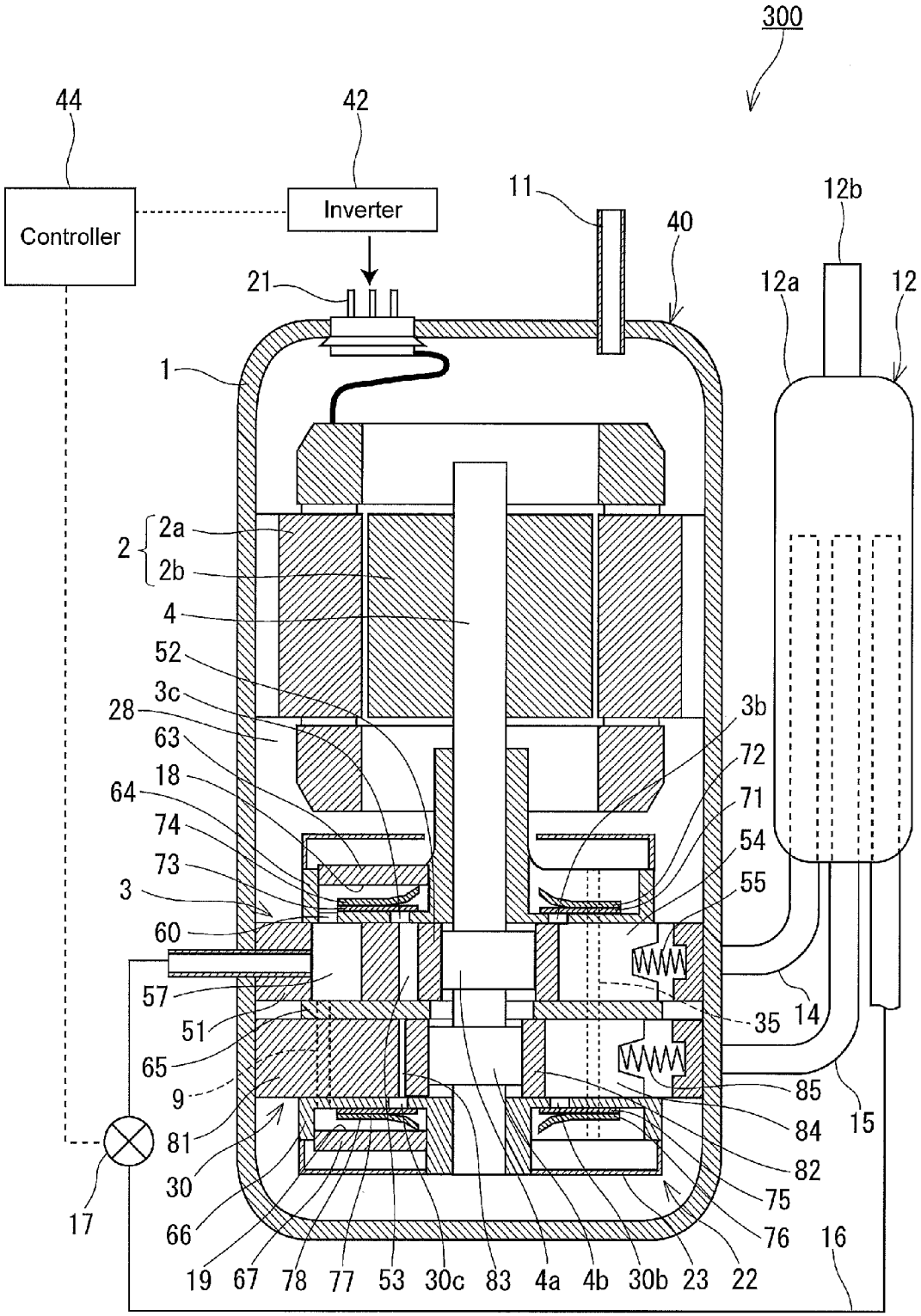
FIG. 13 is a longitudinal cross-sectional view of a rotary compressor according to a third embodiment of the present invention.

As shown in FIG. 13, a rotary compressor 300 of the present embodiment has a configuration resembling that obtained by reversing the positions of the first compression mechanism 3 and the second compression mechanism 30 in the rotary compressor 200 of the second embodiment. Furthermore, in the present embodiment, a second return port 30*c* for allowing the refrigerant to escape from the second compression-discharge chamber 83*b*, and a second back-pressure chamber 19 that communicates with the second return port 30*c*, are provided in the second sealing member 66 of the second compression mechanism 30. The upstream end of the return path 16 is connected not only to the first back-pressure chamber 18 but also to the second back-pressure chamber 19.

In the rotational direction of the shaft 4, the angular distance from the second vane 84 to the second return port 30*c* is preferably approximately equal to the angular distance from the first vane 54 to the first return port 3*c*. Here, the phrase "approximately equal" means that the difference between these angular distances is within 10 degrees. For example, similar to the first return port 3*c*, the second return port 30*c* may be formed at a position that is 180 degrees opposite to the position of the second vane 84 with respect to the axial center of the shaft 4.

It should be noted that the relation of the second return port 30*c* with the second discharge port 30*b* and the second piston 82 also preferably satisfies the conditions (Db≤Dd, Db<Rp1−Rp2, Lb<Rc) described in the first embodiment for a preferred configuration.

The second back-pressure chamber 19 is composed of a recess formed in the lower surface of the second sealing member 66 and a cap 67 covering the recess, and is separated from the internal space of the muffler 23, and also from the internal space 28 of the closed casing 1. In addition, a flow path 9 is provided that penetrates through the second sealing member 66, the second cylinder 81, and the intermediate plate 65 so as to allow communication between the second back-pressure chamber 19 and the intermediate chamber 57. In other words, the upstream end of the return path 16 is connected to the second back-pressure chamber 19 via the intermediate chamber 57 and the flow path 9.

A second check valve 77 that elastically deforms to open and close the second return port 30*c*, and a stopper 78 that regulates the amount of deformation of the second check valve 77, are disposed in the second back-pressure chamber 19. Specifically, the second check valve 77 is a reed valve made of a thin metal plate and having an elongated shape.

With the configuration of the present embodiment, the amount of change in the suction volume of the first compression mechanism 3 and the amount of change in the suction volume of the second compression mechanism 30 can be made approximately equal, and the rotation torque per one rotation generated in the first compression mechanism 3 and the rotation torque per one rotation generated in the second compression mechanism 30 are made equal. In addition, as described in the second embodiment, there is a time difference corresponding to 180 degrees between when the first compression mechanism 3 is at top dead center and when the second compression mechanism 30 is at top dead center. Therefore, the rotation torque fluctuations generated in the shaft 4 can be canceled out. As a result, it becomes easy to control the rotational speed of the motor 2, which leads to improvement in the motor efficiency. Furthermore, since the variation of the rotational speed can be reduced, the reliability of the device can be improved, and noise can be reduced.

It should be noted that the portion of the flow path 9 that corresponds to the second cylinder 81 may be widened, and the return path 16 may be joined to the second cylinder 81 in such a manner that the upstream end of the return path 16 opens into the widened portion.

Fourth Embodiment

Figure 14:
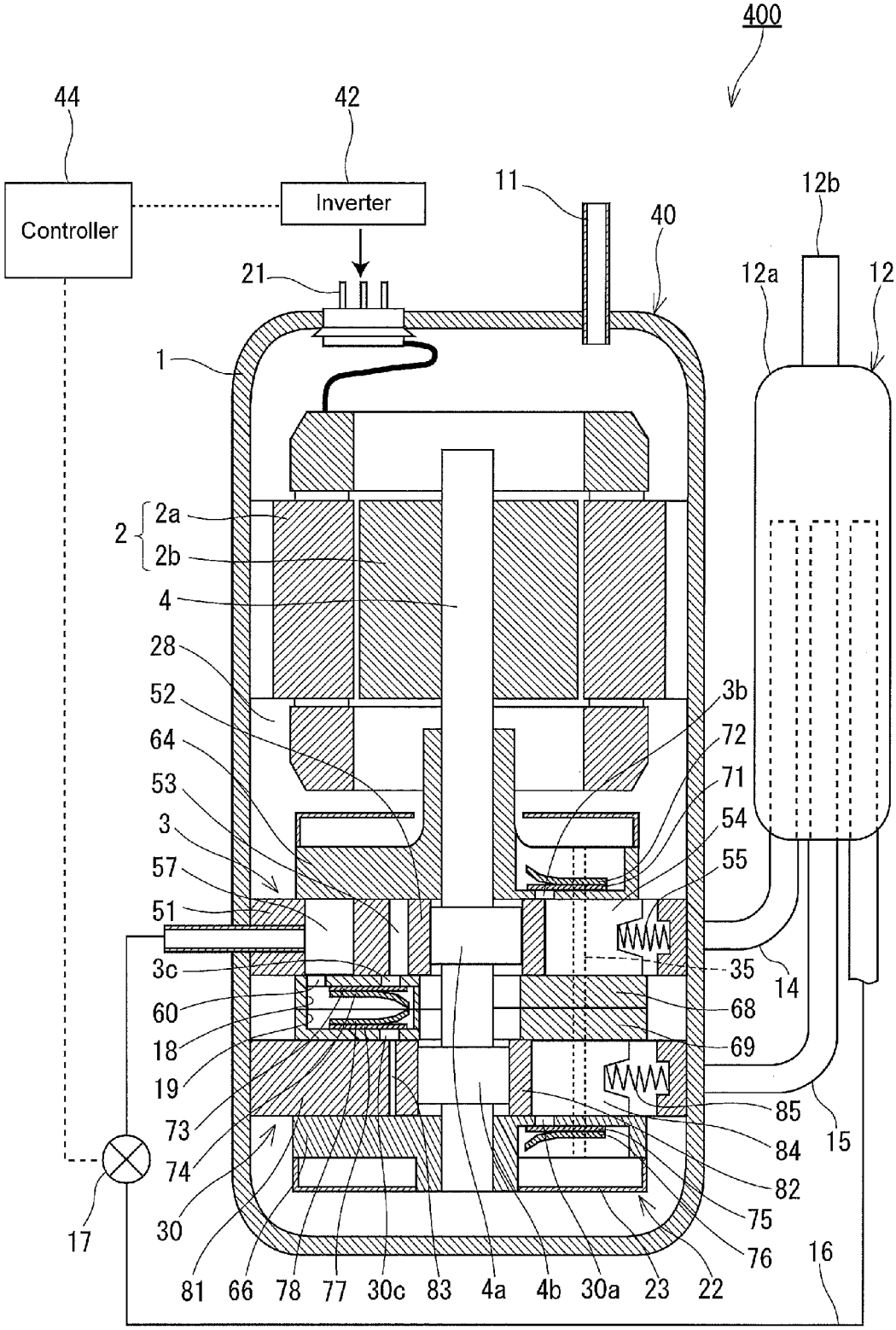
FIG. 14 is a longitudinal cross-sectional view of a rotary compressor according to a fourth embodiment of the present invention.

As shown in FIG. 14, a rotary compressor 400 of the present embodiment has a configuration which resembles that of the rotary compressor 300 of the third embodiment and in which a first intermediate plate 68 and a second intermediate plate 69 placed on each other are provided instead of the intermediate plate 65. That is, the first compression mechanism 3 and the second compression mechanism respectively have the first intermediate plate 68 and the second intermediate plate 69.

The first intermediate plate 68 seals the lower side of the first working chamber 53, and the second intermediate plate 69 seals the upper side of the second working chamber. In the present embodiment, the first return port 3*c* and the first back-pressure chamber 18 are provided in the first intermediate plate 68, and the second return port 30*c* and the second back-pressure chamber 19 are provided in the second intermediate plate 69.

In the configuration of the present embodiment, the first back-pressure chamber 18 is separated from the internal space of the closed casing 1 by the second intermediate plate 69, and the second back-pressure chamber 19 is separated from the internal space of the closed casing 1 by the first intermediate plate 68. Therefore, the caps 63 and 67 as shown in FIG. 13 are unnecessary, and thus the number of components can be reduced. In addition, in the case where the first back-pressure chamber 18 and the second back-pressure chamber 19 are provided at such positions that they form a continuous space, the communication path 9 as shown in FIG. 13 is unnecessary, and thus the configuration can further be simplified.

Applied Embodiment

Figure 15:
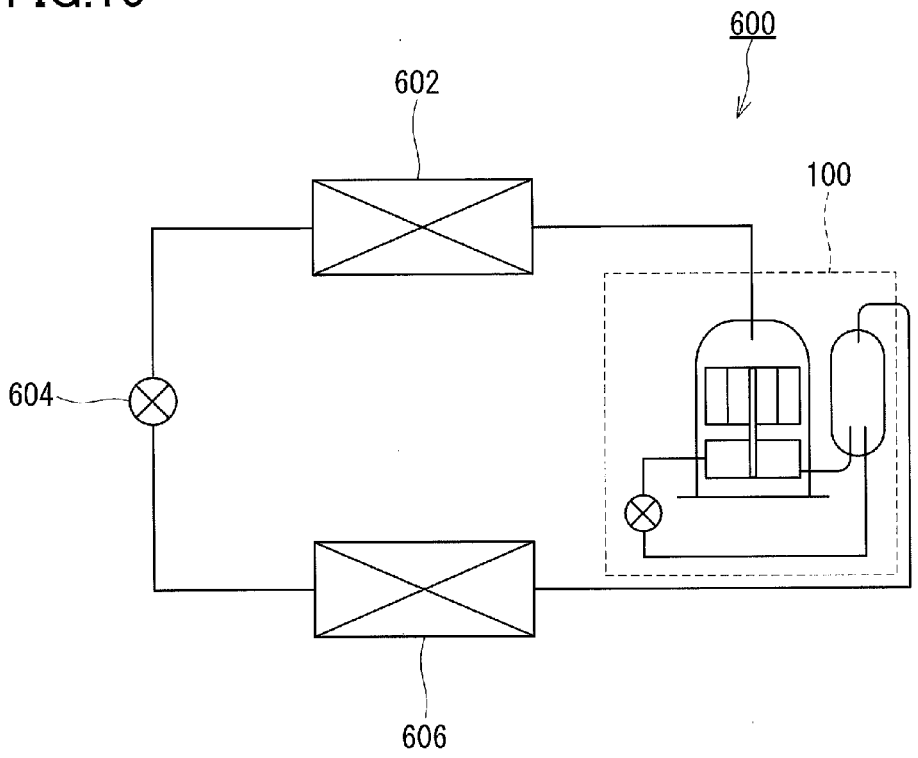
FIG. 15 is a configuration diagram of a refrigeration cycle apparatus in which a rotary compressor of one of the present embodiments is used.
Figure 16:
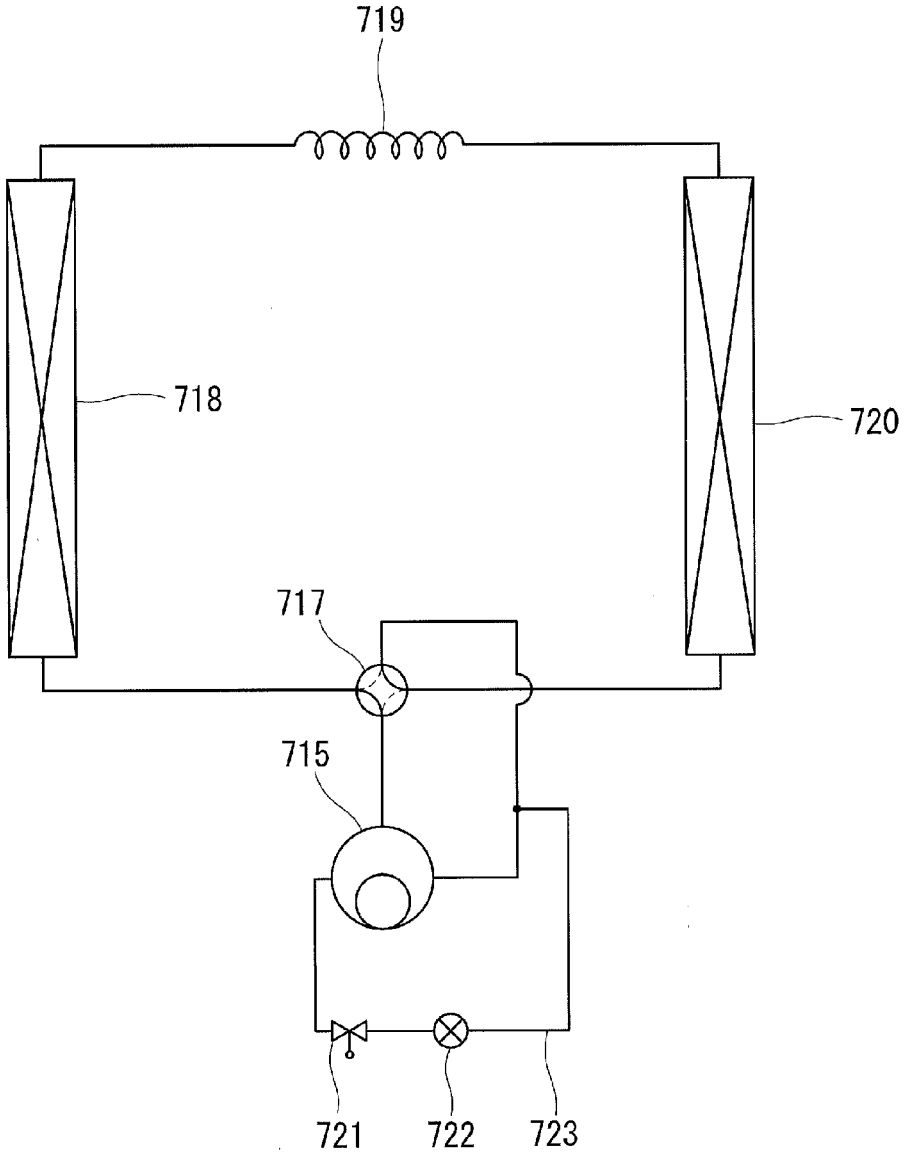
FIG. 16 is a configuration diagram of a conventional air conditioner.

As shown in FIG. 15, a refrigeration cycle apparatus 600 can be built using the rotary compressor 100 of the first embodiment. The refrigeration cycle apparatus 600 includes the rotary compressor 100, a heat radiator 602, an expansion mechanism 604, and an evaporator 606. These devices are connected in the above order by refrigerant pipes so as to form a refrigerant circuit. For example, the heat radiator 602 is an air-refrigerant heat exchanger, and cools the refrigerant compressed by the rotary compressor 100. For example, the expansion mechanism 604 is an expansion valve, and expands the refrigerant cooled by the heat radiator 602. For example, the evaporator 606 is an air-refrigerant heat exchanger, and heats the refrigerant expanded by the expansion mechanism 604. Any of the rotary compressors 200 to 400 of the second to fourth embodiments may be used instead of the rotary compressor 100 of the first embodiment.

Other Embodiments

The several embodiments described in the present specification can be modified without departing from the gist of the invention. For example, the volume-varying valve 17 need not be an on-off valve. The volume-varying valve 17 used to preclude the working fluid from flowing through the return path 16 can be a three-way valve provided in the return path 16 so as to introduce the high-pressure refrigerant from the refrigerant circuit into the back-pressure chamber 18.

In addition, at startup of the rotary compressor 100, the volume-varying valve 17 can be controlled so as to allow the refrigerant to return from the compression-discharge chamber 53*b* to the suction path 14 through the back-pressure chamber 18 and the return path 16. That is, at startup, the rotary compressor 100 is operated temporarily in the low volume mode.

INDUSTRIAL APPLICABILITY

The present invention is useful for a compressor of a refrigeration cycle apparatus which is usable for a hot water dispenser, a hot water heater, an air conditioner, or the like. The present invention is particularly useful for a compressor of an air conditioner for which a broad range of power is required.

The invention claimed is:

1. A rotary compressor comprising: a first compression mechanism comprising a first cylinder, a first piston disposed inside the first cylinder so as to form a first working chamber between an outer circumferential surface of the first piston and an inner circumferential surface of the first cylinder, a first vane that divides the first working chamber into a first suction chamber and a first compression-discharge chamber, a first suction port through which a working fluid to be compressed flows into the first suction chamber, a first discharge port through which the working fluid having been compressed flows out of the first compression-discharge chamber, and a first return port through which the working fluid is allowed to escape from the first compression-discharge chamber; a shaft having an first eccentric portion fitted to the first piston; a motor that rotates the shaft; a first suction path through which the working fluid is directed to the first suction port; a first back-pressure chamber that communicates with the first return port; a first check valve of a reed valve type that is provided in the first back-pressure chamber and that elastically deforms to open and close the first return port; a return path through which the working fluid is returned from the first back-pressure chamber to the first suction path;

a volume-varying valve that is provided in the return path for varying a suction volume of the first compression mechanism, that selectively allows the working fluid to flow through the return path or precludes the working fluid from flowing through the return path to increase a pressure inside the first back-pressure chamber;

an inverter that drives the motor; and a digital processor communicating with the volume-varying valve and the inverter and configured to control the volume-varying valve and the inverter so as to compensate for a decrease in the suction volume with an increase in a rotational speed of the motor, wherein when the first check valve deforms, a first flow passage that allows the working fluid to flow is formed, the first flow passage passing through the return port, the first back-pressure chamber and the return path in this order, the rotary compressor further comprising an accumulator that has an internal space capable of retaining the working fluid and to which the first suction path and the return path are connected, wherein the return path communicates with the first suction path via the internal space of the accumulator;

the rotary compressor further comprises: a second compression mechanism comprising a second cylinder, a second piston disposed inside the second cylinder so as to form a second working chamber between an outer circumferential surface of the second piston and an inner circumferential surface of the second cylinder, a second vane that divides the second working chamber into a second suction chamber and a second compression-discharge chamber, a second suction port through which the working fluid to be compressed is allowed to flow into the second suction chamber, and a second discharge port through which the working fluid having been compressed is allowed to flow out of the second compression-discharge chamber; and a second suction path through which the working fluid is directed from the internal space of the accumulator to the second suction port, the shaft further having a second eccentric portion fitted to the second piston, the second compression mechanism further comprises a second return port through which the working fluid is allowed to escape from the second compression-discharge chamber, the rotary compressor further comprises a second back-pressure chamber that communicates with the second return port, and a second check valve of a reed valve type that is provided in the second back-pressure chamber and that elastically deforms to open and close the second return port, and an upstream end of the return path is connected not only to the first back-pressure chamber but also to the second back-pressure chamber.

2. The rotary compressor according to claim 1, wherein each one of the first and second compression mechanisms further comprises a pair of sealing members sealing both sides of each of the first and second working chambers in an axial direction of the shaft, and each of the first and second return ports and each of the first and second back-pressure chambers are provided in each one of the pair of the sealing members.

3. The rotary compressor according to claim 1, further comprising a closed casing housing the first and second compression mechanisms and the motor, wherein the first and second discharge ports open into an internal space of the closed casing, and the first and second back-pressure chambers are separated from the internal space of the closed casing.

4. The rotary compressor according to claim 1, wherein a suction volume of the second compression mechanism keeps constant.

5. The rotary compressor according to claim 4, wherein the suction volume of the first compression mechanism is substantially zero in a low volume mode in which the working fluid is allowed to flow through the return path.

6. The rotary compressor according to claim 5, wherein the first compression mechanism and the second compression mechanism share an intermediate plate sandwiched between the first cylinder and the second cylinder, and sealing one side of the first working chamber and one side of the second working chamber in an axial direction of the shaft, the first compression mechanism comprises a first sealing member sealing the other side of the first working chamber that is opposite to the intermediate plate, the second compression mechanism comprises a second sealing member sealing the other side of the second working chamber that is opposite to the intermediate plate, the first sealing member and the second sealing member function also as bearings by which the shaft is rotatably supported, and a first diameter of a portion of the shaft that is supported by the first sealing member has a smaller diameter than a second diameter of a portion of the shaft that is supported by the second sealing member.

7. The rotary compressor according to claim 1, wherein, in a rotational direction of the shaft, an angular distance from the first vane to the first return port is approximately equal to an angular distance from the second vane to the second return port.

8. The rotary compressor according to claim 1, wherein the first compression mechanism and the second compression mechanism share an intermediate plate sandwiched between the first cylinder and the second cylinder, and sealing one side of the first working chamber and one side of the second working chamber in an axial direction of the shaft, the first compression mechanism comprises a first sealing member sealing the other side of the first working chamber that is opposite to the intermediate plate, the second compression mechanism comprises a second sealing member sealing the other side of the second working chamber that is opposite to the intermediate plate, and the first return port and the first back-pressure chamber are provided in the first sealing member, and the second return port and the second back-pressure chamber are provided in the second sealing member.

9. The rotary compressor according to claim 1, wherein the first compression mechanism comprises a first intermediate plate sealing one side of the first working chamber that faces toward the second compression mechanism, and a first sealing member sealing the other side of the first working chamber that is opposite to the first intermediate plate, the second compression mechanism comprises a second intermediate plate sealing one side of the second working chamber that faces toward the first compression mechanism, and a second sealing member sealing the other side of the second working chamber that is opposite to the second intermediate plate, the first intermediate plate and the second intermediate plate are placed on each other, and the first return port and the first back-pressure chamber are provided in the first intermediate plate, and the second return port and the second back-pressure chamber are provided in the second intermediate plate.

10. The rotary compressor according to claim 1, wherein a diameter Db of each of the first and second return ports and a diameter Dd of each of the first and second discharge ports satisfy a relation $Db \leq Dd$.

11. The rotary compressor according to claim 1, wherein a diameter Db of each of the first and second return ports, an outer radius Rp1 of each of the first and second pistons, and an inner radius Rp2 of each of the first and second pistons, each satisfies a relation $Db < Rp1 - Rp2$.

12. The rotary compressor according to claim 1, wherein a distance Lb between a center of the each one of the first and second return ports and a center of an inner diameter of the each one of the first and second cylinders, and an inner radius Rc of the each one of the first and second cylinders, satisfy a relation $Lb < Rc$.

* * * * *